US012091871B2

(12) United States Patent
Wells

(10) Patent No.: US 12,091,871 B2
(45) Date of Patent: Sep. 17, 2024

(54) TEMPORARY PROTECTIVE COMPARTMENTALIZATION SYSTEM FOR USE DURING CONSTRUCTION AND DEMOLITION

(71) Applicant: Simon Wells, Fort Lauderdale, FL (US)

(72) Inventor: Simon Wells, Fort Lauderdale, FL (US)

( * ) Notice: Subject to any disclaimer, the term of this patent is extended or adjusted under 35 U.S.C. 154(b) by 0 days.

(21) Appl. No.: 18/613,773

(22) Filed: Mar. 22, 2024

(65) Prior Publication Data

US 2024/0263468 A1 Aug. 8, 2024

Related U.S. Application Data

(63) Continuation of application No. 18/533,806, filed on Dec. 8, 2023, and a continuation-in-part of application No. 18/238,106, filed on Aug. 25, 2023, now Pat. No. 11,851,899, and a continuation-in-part of application No. 18/138,052, filed on Apr. 22, 2023, now Pat. No. 11,814,854, and a continuation-in-part of application No. 18/105,814, filed on Feb. 4, 2023.

(51) Int. Cl.
*E04G 21/30* (2006.01)

(52) U.S. Cl.
CPC ..... *E04G 21/30* (2013.01)

(58) Field of Classification Search
CPC ..... E04G 21/30; E04F 13/075
See application file for complete search history.

(56) References Cited

U.S. PATENT DOCUMENTS

| | | | | |
|---|---|---|---|---|
| 3,895,981 | A * | 7/1975 | Tesch | E04F 11/163 52/181 |
| 6,640,501 | B1 * | 11/2003 | Hussey | E04G 21/30 52/177 |
| 6,996,860 | B1 * | 2/2006 | Blake | A47K 3/001 4/504 |
| 7,228,668 | B2 * | 6/2007 | Gibney | E04G 21/30 52/211 |
| 7,749,588 | B2 * | 7/2010 | Blake | B32B 29/08 428/184 |
| 7,823,332 | B2 * | 11/2010 | Siegel | A47G 27/0287 52/177 |
| 8,839,592 | B2 * | 9/2014 | Foran | E04G 21/243 52/796.1 |
| 9,091,073 | B2 * | 7/2015 | Wells | E04F 15/02 |
| 9,732,533 | B2 * | 8/2017 | Ruzhin | E04G 21/30 |
| 9,945,137 | B2 * | 4/2018 | Prest | E04G 21/30 |
| 9,956,568 | B2 * | 5/2018 | O'Brien | B05C 21/005 |
| 10,570,623 | B1 * | 2/2020 | Wells | E04F 11/17 |
| 10,676,939 | B2 * | 6/2020 | Wells | E04G 21/30 |
| 10,731,339 | B2 * | 8/2020 | Hauserman-Winder | E04B 2/7453 |

(Continued)

*Primary Examiner* — Rodney Mintz
(74) *Attorney, Agent, or Firm* — Melvin K. Silverman

(57) ABSTRACT

The invention presents a temporary protective containment barrier system tailored for construction and demolition. Comprising multiple wall members, each integrates vertical wall panels affixed to adjustable stud members, forming vertical partitions. These stud members feature cantilevers at their upper limits. The system incorporates noggins connecting adjacent stud members and includes ceiling joists and panels. Cantilevers are linked through ceiling joists. Structural fasteners secure noggins and/or ceiling joists. This modular system offers adaptable protection during construction and demolition activities, facilitating containment and safety measures.

17 Claims, 25 Drawing Sheets

(56) References Cited

U.S. PATENT DOCUMENTS 11,002,028 B2 * 5/2021 Rus ..... E04G 21/30
11,149,452 B2 * 10/2021 Rus ..... E04G 21/30
11,293,193 B2 * 4/2022 Rus ..... E04F 11/163
11,486,156 B2 * 11/2022 Rus ..... E04F 11/163
11,814,854 B1 * 11/2023 Wells ..... E04G 21/30
11,851,899 B1 * 12/2023 Wells ..... E04G 21/3209
2003/0196387 A1 * 10/2003 Hussey ..... E04G 21/30 52/3
2004/0261344 A1 * 12/2004 Gibney ..... E04G 21/30 52/506.01
2004/0261346 A1 * 12/2004 Gibney ..... E04G 21/30 52/506.01
2005/0223650 A1 * 10/2005 Blake ..... E04G 21/30 52/3
2008/0066389 A1 * 3/2008 Siegel ..... A47G 27/0287 52/3
2010/0255770 A1 * 10/2010 Blake ..... B32B 3/12 454/367
2013/0236676 A1 * 9/2013 Doyle ..... E04G 21/30 428/57
2014/0033642 A1 * 2/2014 Foran ..... E04G 21/30 52/782.1
2014/0157712 A1 * 6/2014 Wells ..... E04G 21/30 52/796.1
2015/0056401 A1 * 2/2015 Farah ..... B32B 37/22 156/547
2016/0312484 A1 * 10/2016 Ruzhin ..... E04G 21/30
2017/0183883 A1 * 6/2017 Rus ..... E04G 21/30
2017/0189925 A1 * 7/2017 O'Brien ..... B05C 21/005
2018/0347205 A1 * 12/2018 Rus ..... E04F 11/166
2018/0347215 A1 * 12/2018 Rus ..... E04G 21/30
2018/0347216 A1 * 12/2018 Rus ..... E04F 11/104
2018/0353051 A1 * 12/2018 Clark ..... A47L 13/10
2019/0085572 A1 * 3/2019 Rus ..... E04G 21/30
2019/0186129 A1 * 6/2019 Hauserman-Winder ..... E04B 2/7453
2020/0040585 A1 * 2/2020 Wells ..... E04F 11/163
2020/0123781 A1 * 4/2020 Wells ..... E04F 11/1045
2020/0332543 A1 * 10/2020 Rus ..... E04F 11/163
2021/0238845 A1 * 8/2021 Bickford ..... B32B 9/041
2022/0178138 A1 * 6/2022 Bickford ..... E04B 2/721

* cited by examiner

TEMPORARY PROTECTIVE COMPARTMENTALIZATION SYSTEM FOR USE DURING CONSTRUCTION AND DEMOLITION

CROSS-REFERENCE TO RELATED APPLICATIONS

This application is continuation-in-part of Ser. No. 18/533,806, entitled: "Temporary Protective Wall Partition Barrier System for Use During Construction and Demolition", filedDec. 8, 2023, which is a continuation-in-part of Ser. No. 18/238,106, entitled: "System and Method for a Temporary Protective Barrier for Floors and Stairs During Construction and Demolition", filedAug. 25, 2023, now granted U.S. Pat. No. 11,851,899 which is a divisional of co-pending application Ser. No. 18/138,052, entitled: "A System and Method for a Temporary Protective Barrier for Floors and Stairs During Construction and Demolition", filedApr. 22, 2023, now granted U.S. Pat. No. 11,814,854, which is a continuation in part of co-pending application Ser. No. 18/105,814, entitled: "System and Method for a Temporary Protective Structure for Use in Construction and Demolition", filedFeb. 4, 2023, all of which is incorporated by reference in its entirety.

FIELD OF THE INVENTION

The present invention relates temporary structures used in construction and demolition.

BACKGROUND

When the interiors high-end rooms are being refitted, not all surfaces and interiors are demolished. Because these remaining high-end fixtures and surfaces are vulnerable to damage from debris and loose articles from demolition, it is important to include protections against such damage. In general construction and building practices include scaffolding and plastic tarps, typically duct taped together to contain dust. However, this setup does not protect flooring, walls, stairs, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

My previous inventions disclosed a system to handle various situations in demolition and construction. However, when renovating larger spaces, the tunnel systems disclosed in my previous applications are too small to be completely effective in large spaces. Thus, a need exists in the market for a temporary protective barrier that is configurable to protect unaltered areas of a structure under renovation and provide enhanced protection for the surfaces outside the barrier so that damage does not occur, as well as partition larger rooms for partial areas of construction. There exists a further need to provide larger partitioned sections with an embodiment that also provides upper protection as a ceiling for use in spaces that have a large height, such as double height rooms, conference centers, stadiums and arenas, and similar implementations.

My previously filed U.S. patent application Ser. No. 18/105,814, entitled "*A System and Method for a Temporary Protective Structure for Use in Construction and Demolition*" disclosed a system and method of a temporary protective structural system that focused on the overall system employed. That system includes a plurality of frame members. The frame members define a pair of opposing studs and integrated top plate. The system also includes noggings connecting the studs. Ceiling joists are also included. The combination creates at least one free-standing tunnel module. Vertical wall panels are secured to the exteriors of the free-standing tunnel modules, thereby vertically enclosing the free-standing tunnel modules. Horizontal ceiling panels are secured to an exterior ceiling area of the tunnel modules. Horizontal floor panels provide a protective surface for the floor. When constructed, the combination of elements and tunnel modules create a protective barrier for sensitive surfaces in a construction zone.

My previously filed U.S. patent application Ser. No. 18/138,052, and U.S. patent application Ser. No. 18/238,106, disclose a temporary protective system and method that introduces a floor covering and stair protection system, as well as the method of use and combination with the temporary tunnel system. However, more consideration needs to be given to a wall partition systems that may be easily applied to larger rooms where only a particular area is being worked. My U.S. patent application Ser. No. 18/533,806, entitled "A Temporary Protective Wall Partition Barrier System for Use During Construction and Demolition" addressed this in part. The disclosure herein expands on the use of these temporary barriers in applications. In addition to disclosing an expandable ceiling system for implementations where panels cannot be readily secured to the ceiling, the current system adds in securement attachments, known as structural fasteners, to anchor the pieces together. This, in turn, provides the solution for many problems in the industry in an easily executable configuration.

SUMMARY OF THE INVENTION

The invention disclosed herein provides a temporary protective containment barrier system for use during construction and demolition. The temporary protective containment barrier system comprises a plurality of wall members. Each wall member in the plurality of wall members includes at least one vertical wall panel secured to an interior area of a vertically adjustable stud member, thereby creating a vertical partition. The plurality of wall members is comprised of a plurality of the vertically adjustable stud members. Each stud member has a cantilever positioned at an upper boundary. The protective containment barrier system also includes a plurality of noggins. Each vertically adjustable stud member in the plurality of vertically adjustable stud members is connectable to a neighboring stud member by the plurality of noggins. The protective containment barrier system also includes at least one ceiling joist and at least one ceiling panel. Each cantilever in the plurality of vertically adjustable stud members is connectable to a neighboring cantilever by the at least one ceiling joist. Several structural fasteners are configured to secure the noggins and/or the ceiling joists to additional noggins and/or ceiling joists in a plurality of noggins or ceiling joists.

It is an object of the present invention to provide a system capable of being readily assembled and disassembled with minimal pieces outside the overall system.

It is yet another object of the present invention is to provide a system that can be used to create a partition and a protective barrier inclusive of a faux ceiling for use in demolition or construction areas.

It is a further object to provide a system that incorporates cushioned material to shield exposed surfaces of the structure.

Finally, it is an object of the invention to provide a temporary wall barrier capable of thermal insulative properties, noise dampening, and adjustable height and dimensions.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
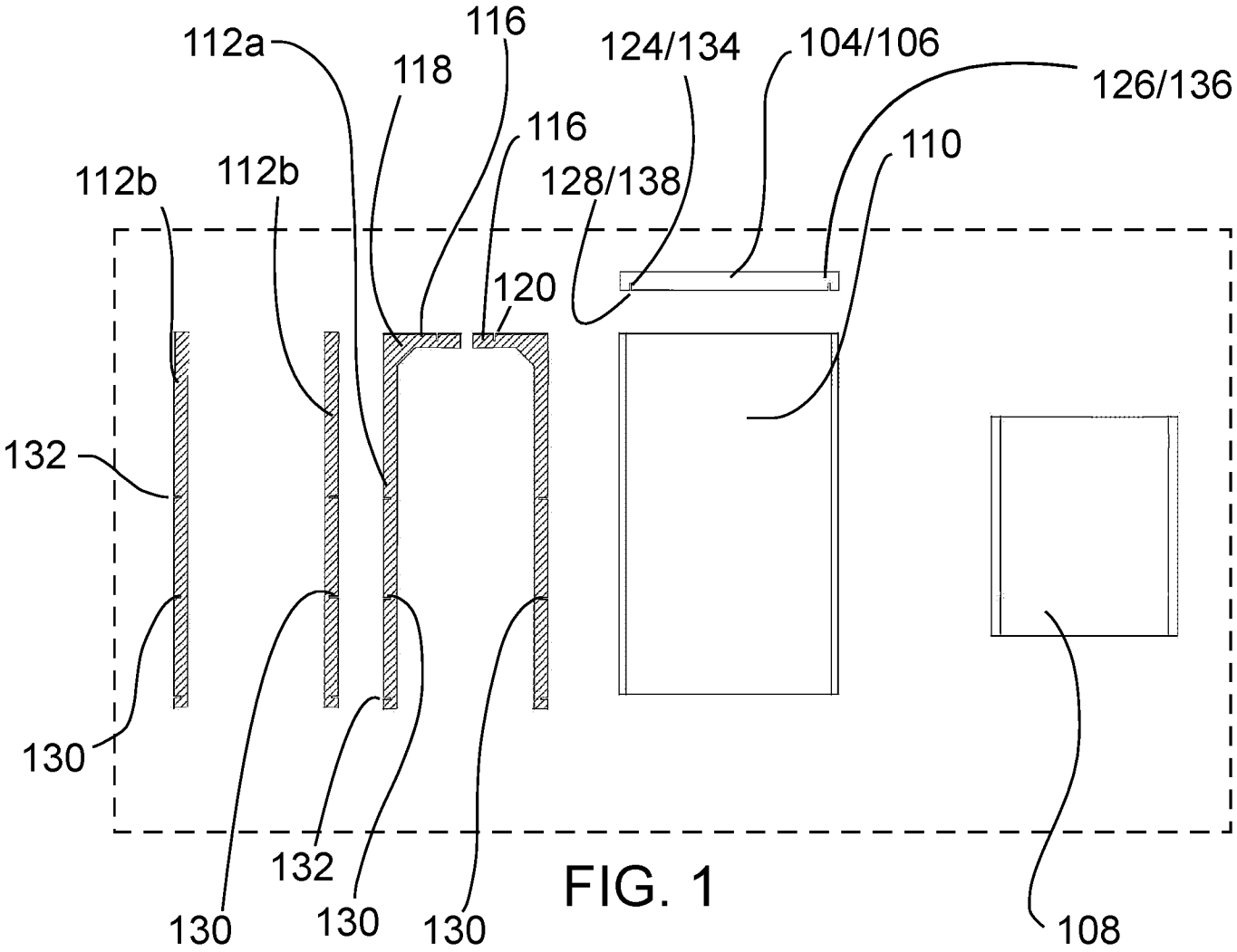
FIG. 1 illustrates a front view of various independent components of the system.
Figure 2:
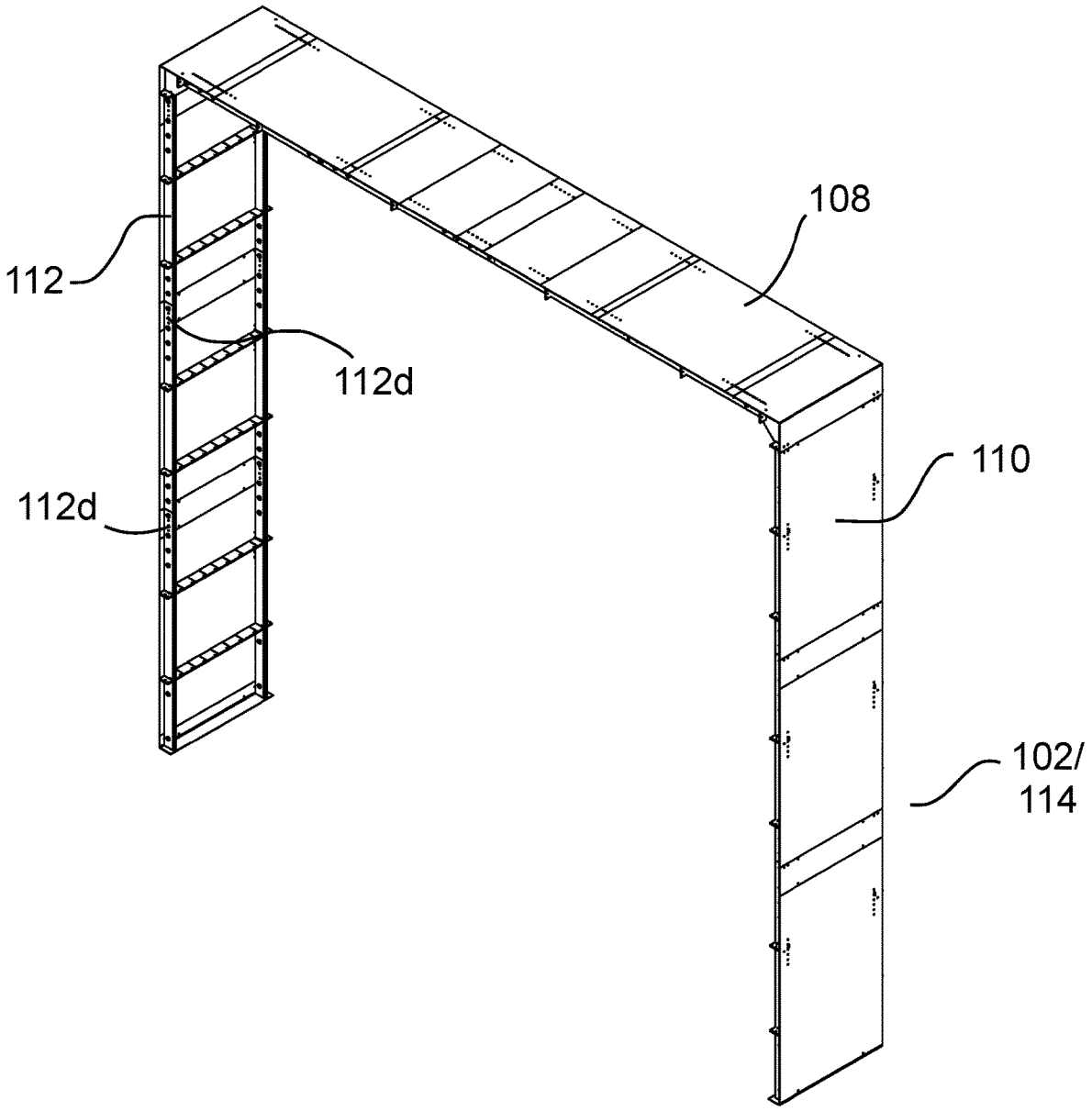
FIG. 2 illustrates an isometric view of an embodiment of the expandable partition system with adjustable ceiling.
Figure 3:
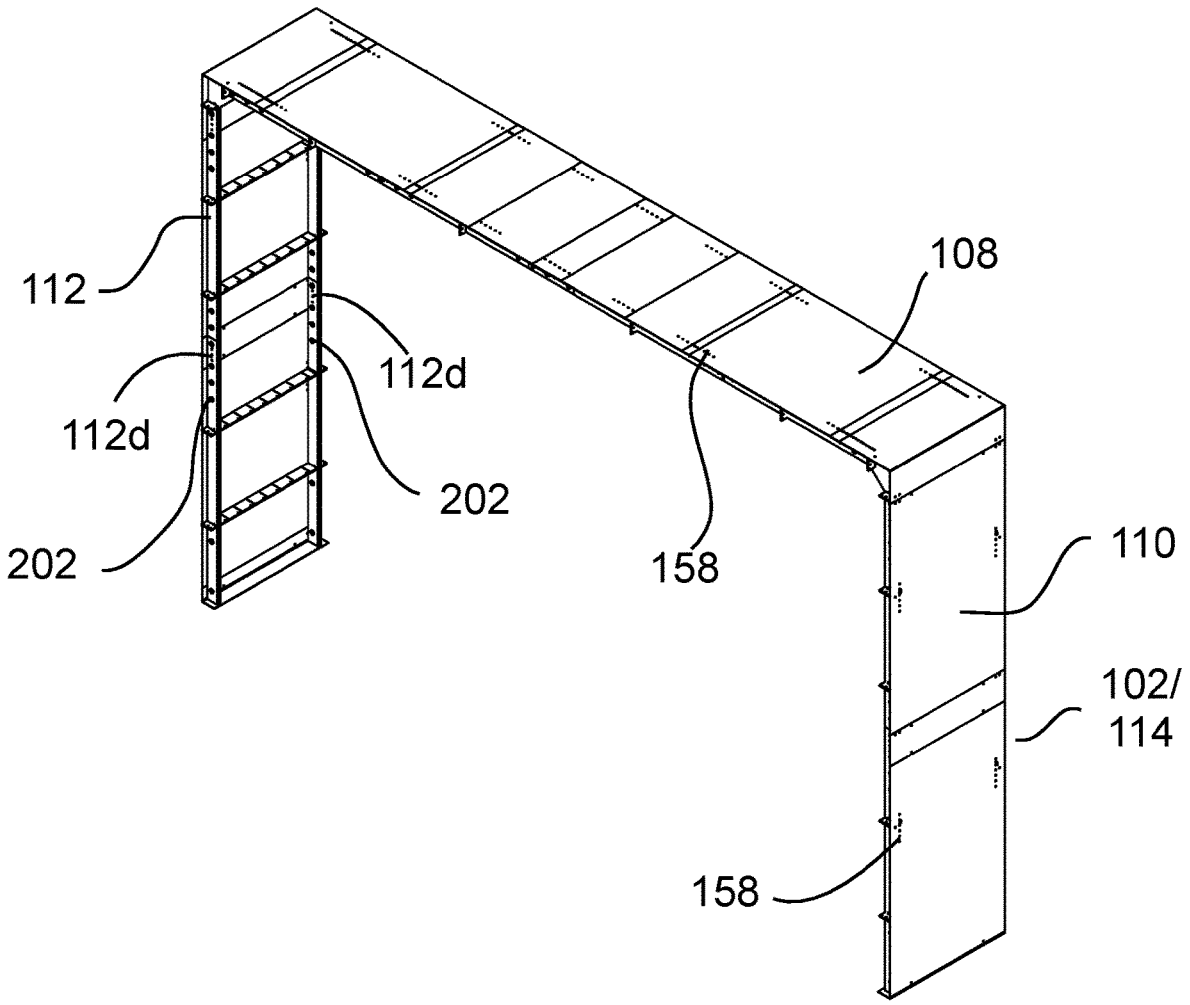
FIG. 3 illustrates an isometric view of an embodiment of the expandable partition system with adjustable ceiling.
Figure 4:
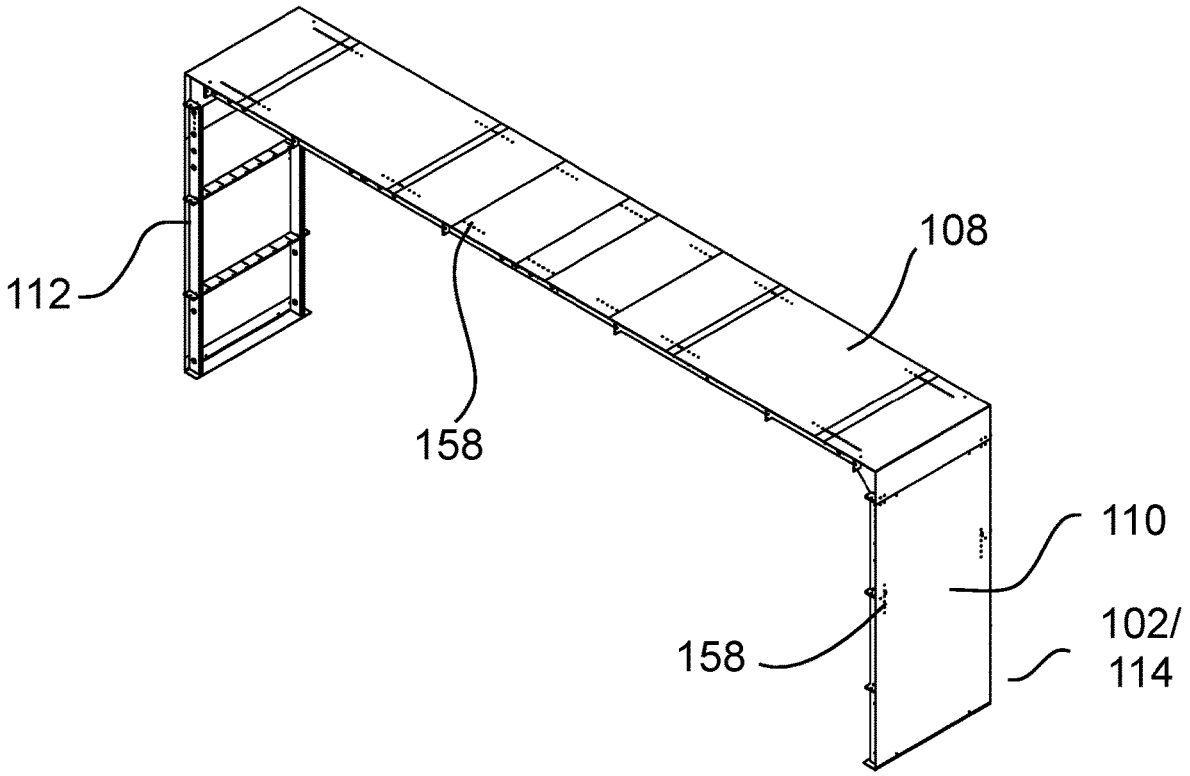
FIG. 4 illustrates an isometric view of an embodiment of the expandable partition system with adjustable ceiling.
Figure 5:
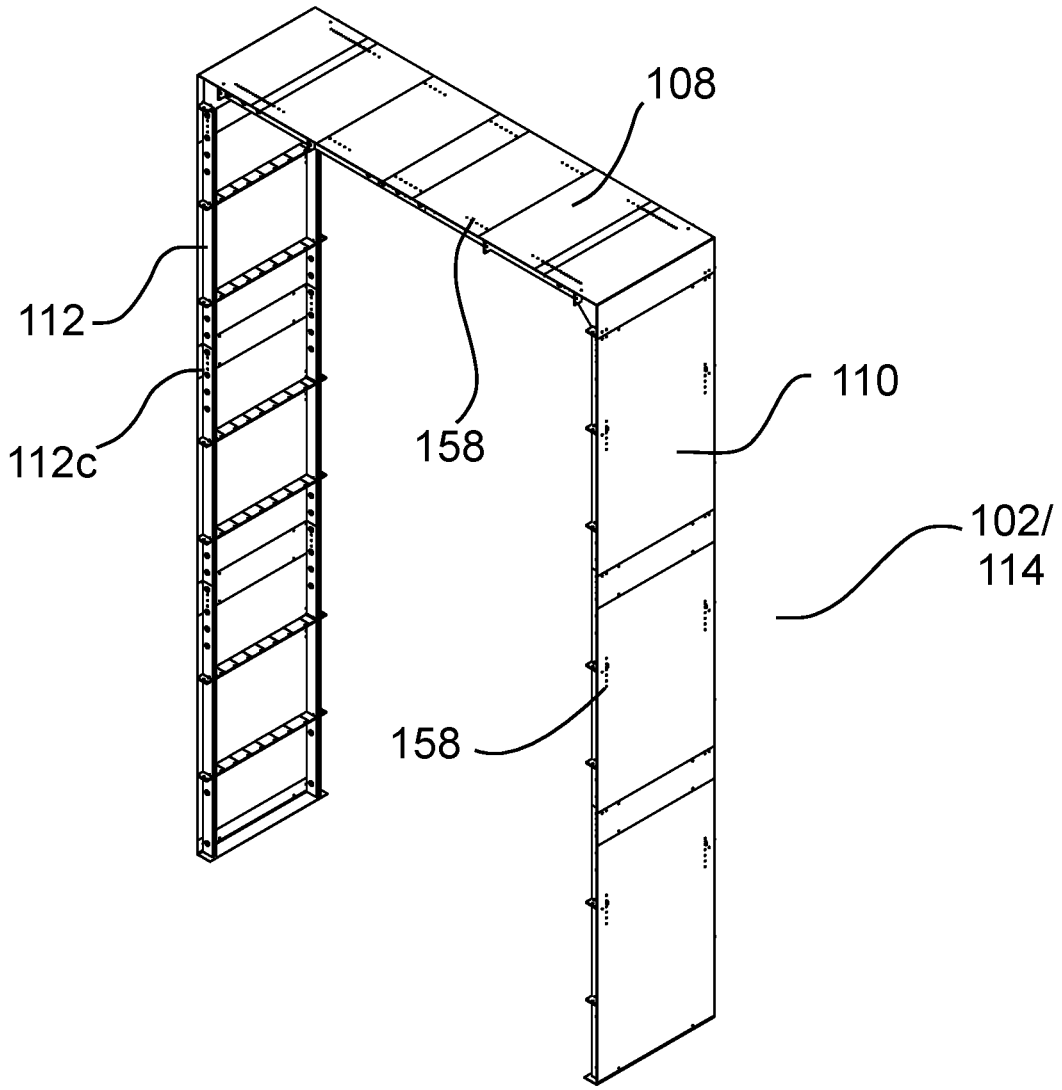
FIG. 5 illustrates an isometric view of an embodiment of the expandable partition system with adjustable ceiling.
Figure 6:
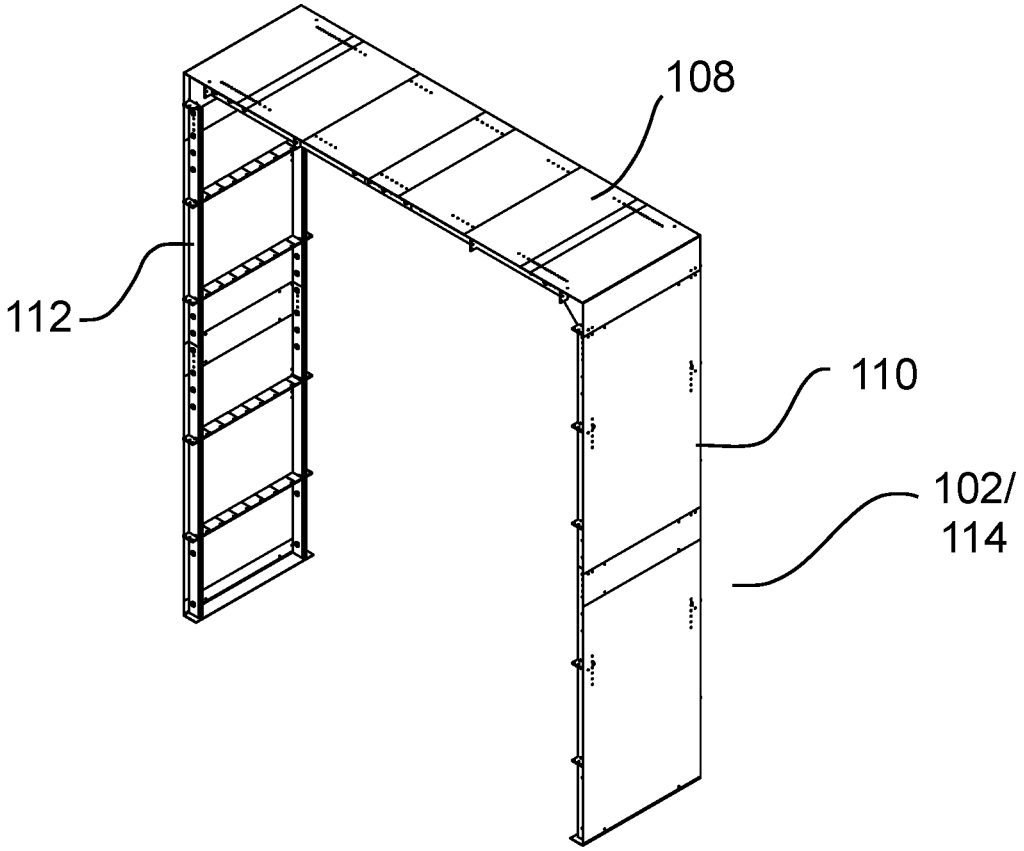
FIG. 6 illustrates an isometric view of an embodiment of the expandable partition system with adjustable ceiling.
Figure 7:
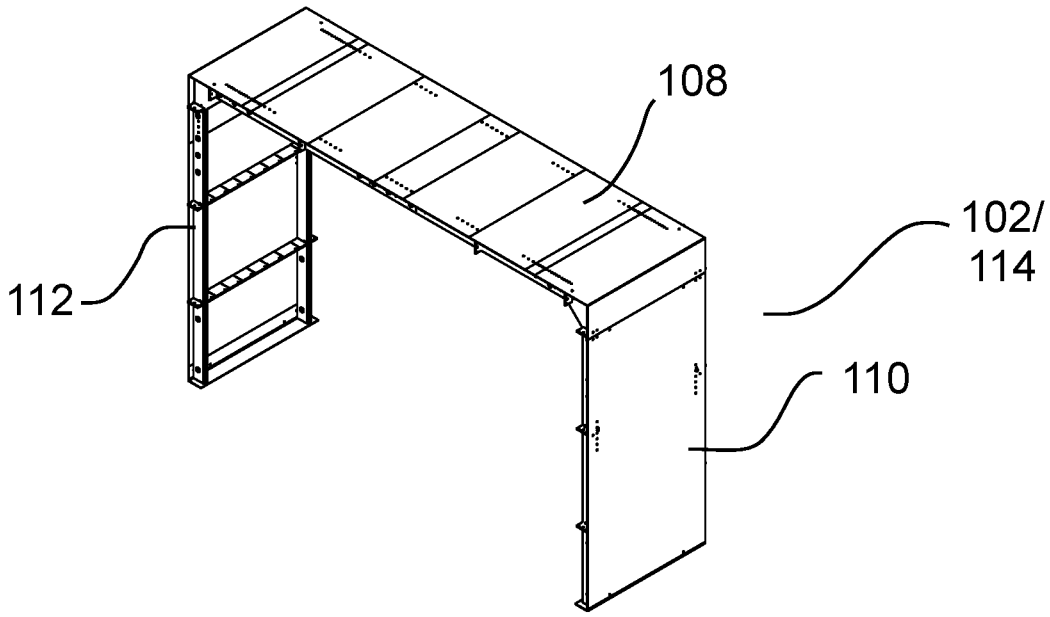
FIG. 7 illustrates an isometric view of an embodiment of the expandable partition system with adjustable ceiling.

The invention herein provides a solution for protecting and maintaining the safety and integrity of unaltered fixtures and surfaces during demolition and construction. The invention includes a uniquely configured barrier system that focuses on room partitions, fastening and anchoring devices in the components therein, and in some embodiments, a ceiling component to provide upper shelter in spaces where a ceiling height of a room may be larger than the required partition height. This system complements my other inventions, which include coverings for the stairs (both riser and tread), that is customizable in size and volume, and includes an anchor system to protect flooring and stairs during construction and demolition. This system further compliments a frame element system, as I've described in previous patent applications, having members connecting several frame elements to create a frame skeleton. Several protective panels surrounding the skeletal frame are incorporated to provide for protection and containment. This system also complements my most recent disclosure of a wall partition system, capable of extended height beyond the tunnel system. This unique arrangement, in combination, is capable of solving the above issues plaguing current methods of protection during construction.

The disclosure herein combines the teachings of several of my previous disclosures to fill the gaps in product offering to fit the unique application of partitioning off a work area, but also providing a containment at the upper boundary of the partition walls.

As stated above, when high-end interiors being refitted and renovated, not all surfaces and interiors are demolished. Because remaining high-end fixtures and surfaces are vulnerable to damage from debris and loose articles from demolition, it is important to include protections against such damage. Some have created systems to address this issue, including scaffolding and plastic tarps, typically duct taped together to contain dust, but these systems do not protect against flying debris, have any sort of insulative properties, and are not modular in nature. Current systems also do not protect flooring, walls, ceilings and other surfaces from heavier debris, and damage can occur if something is dropped. Typically, builders may include cardboard squares on the floor, however these squares can slide and scrape the floors they're intended to protect.

Other factors may influence what areas are sectioned off, such as livable or occupied area outside the work area, thermal control and the provisional of a thermal boundary for indoor climate control, and sound dampening measures. The above-mentioned previous solutions of scaffolding, plastic tarps, and cardboard squares on the floor do nothing to address these concerns.

The disclosure, herein, complements the solutions disclosed in previous applications, but creates a unique solution for larger spaces with extended heights. When the interiors of spaces are being refitted, the rooms being demolished and remodeled are typically expansive and have a large range of geometric shapes, heights, and overall square footage. While my previously disclosed inventions discuss the modular tunnel system and system and method for covering stairs and floors, this disclosure introduces the unique wall partition structure, capable of insulation, noise dampening, cushioned protection, and a modular and adjustable construction. These embodiments fill a need in the market for a temporary protective barrier for partitioning spaces during construction and demolition that is configurable to protect unaltered foot surfaces of spaces under renovation and provide enhanced protection for the surfaces outside the barrier so that damage does not occur. The current invention builds on this by utilizing an anchor and securement system, as well as a horizontally and vertically expandable system using unique component-based construction, thereby ensuring scalability and customizability to fit each unique application.

The temporary compartmentalization system for use during construction and demolition of the present invention may be used to, among other things, provide a system capable of being readily assembled and disassembled with minimal pieces outside the overall system, provide a system that can be used to create a partition and a protective barrier on flooring and stairs from a demolition or construction area to the outside of the structure where the threat of damage is no longer present, provide a system that incorporates cushioned material to shield exposed surfaces of the structure, and provide a temporary wall barrier capable of thermal insulative properties, noise dampening, and adjustable height and dimensions. This apparatus and system are particularly shown in FIGS. 1-26.

Figure 8:
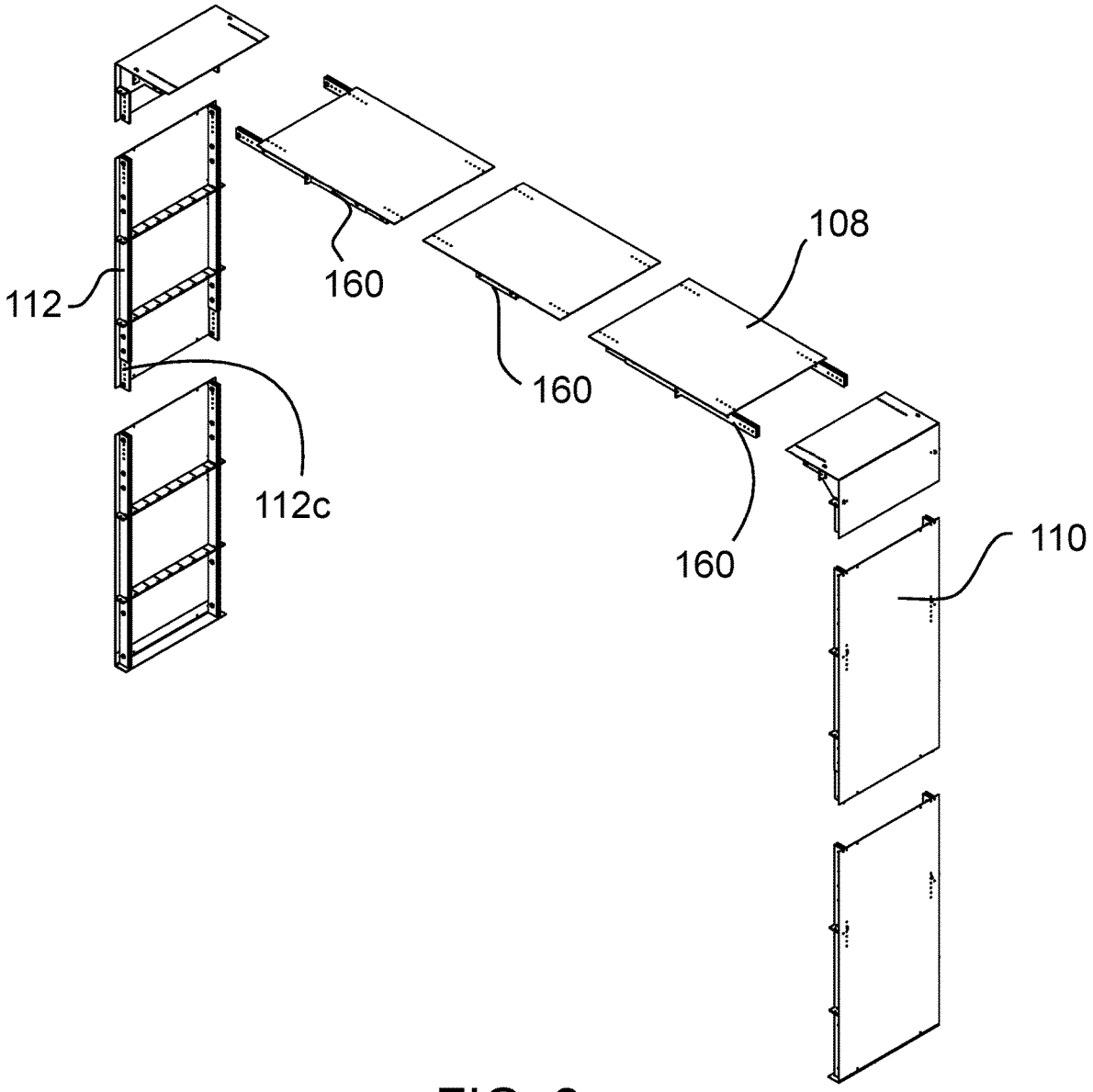
FIG. 8 illustrates an exploded isometric view of an embodiment of the expandable partition system with adjustable ceiling.
Figure 9:
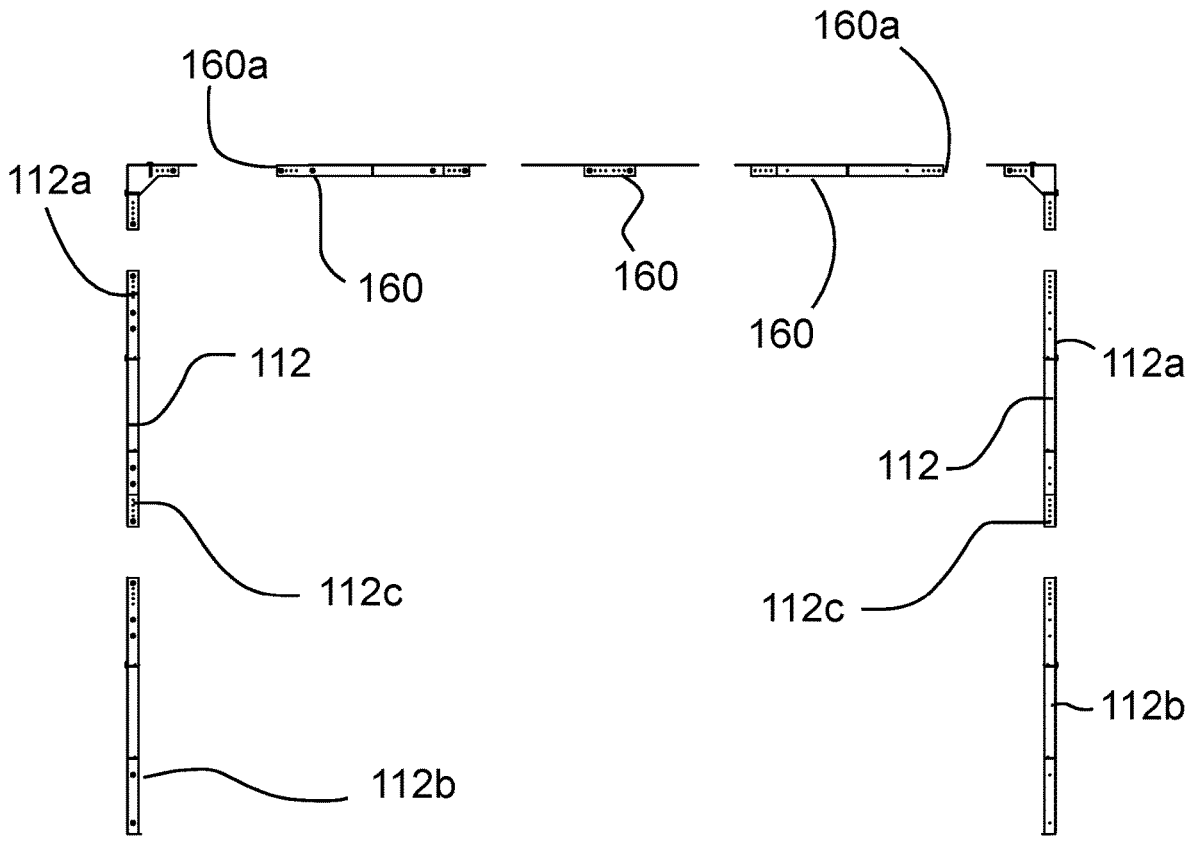
FIG. 9 illustrates an exploded front elevation view of an embodiment of the expandable partition system with adjustable ceiling.
Figure 10:
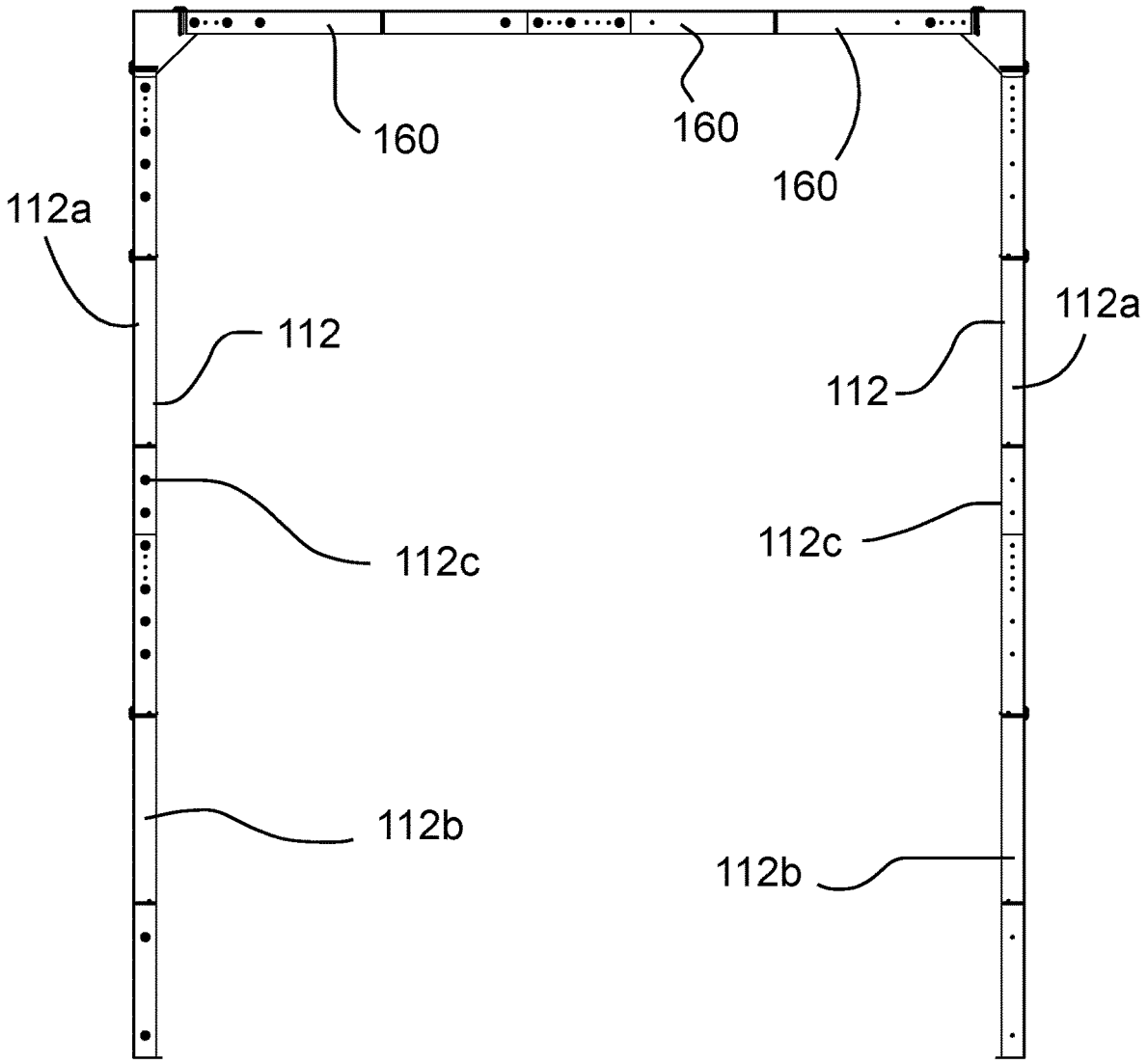
FIG. 10 illustrates a front elevation view of an embodiment of the expandable partition system with adjustable ceiling.
Figure 11:
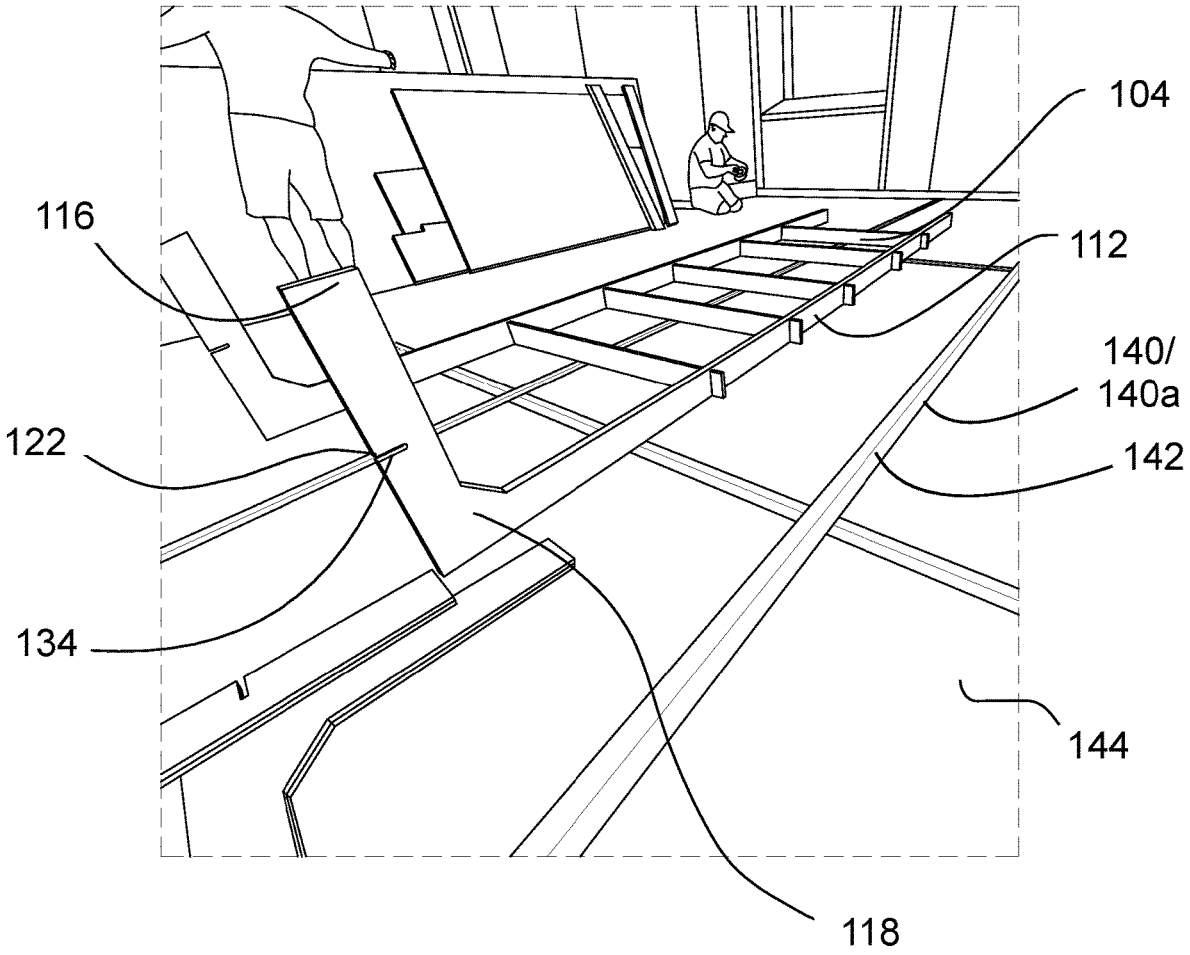
FIG. 11 illustrates a conceptual view of the installation and assembly of an embodiment of the system.
Figure 12:
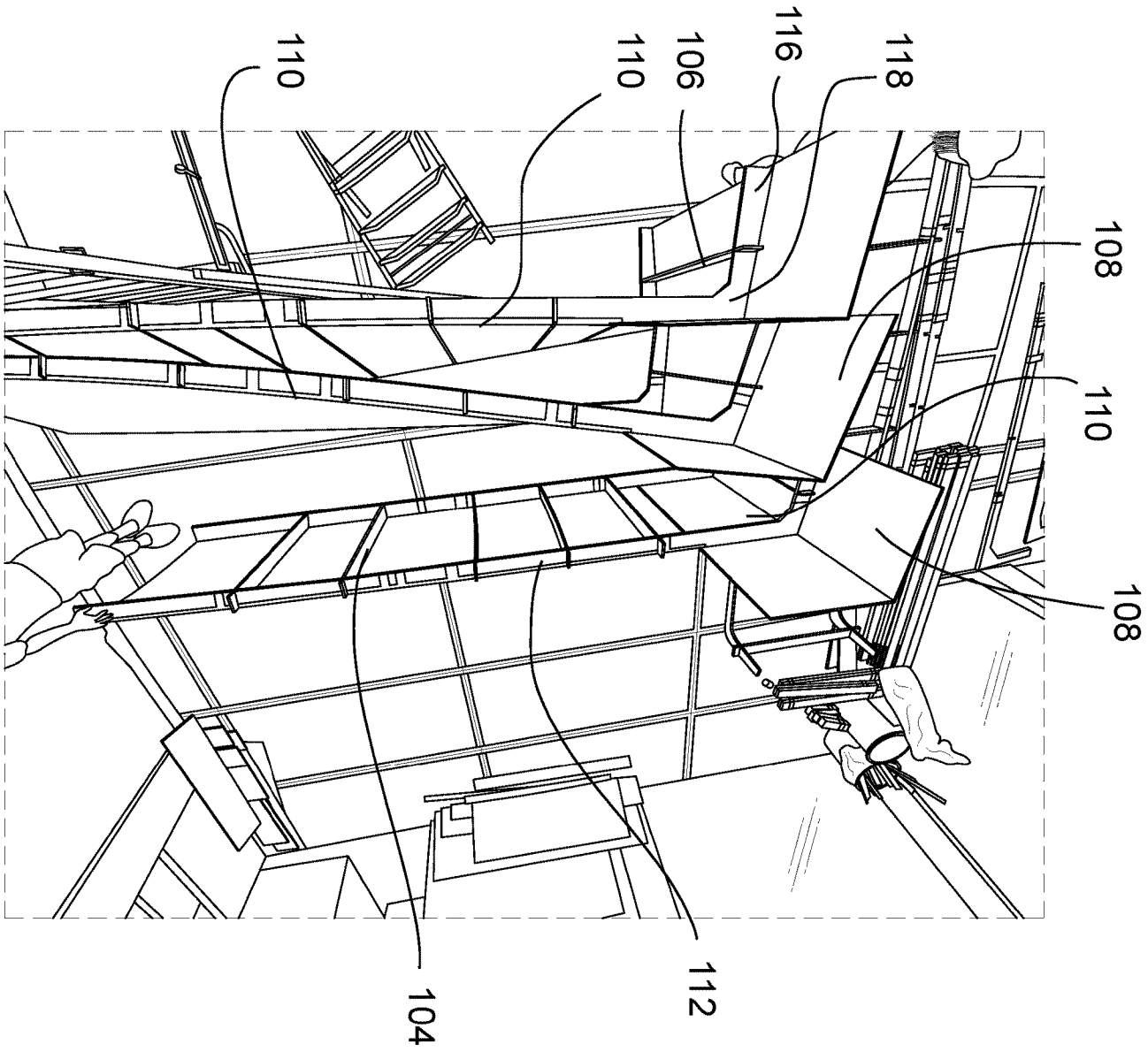
FIG. 12 illustrates a conceptual view of the installation and assembly of an embodiment of the system.
Figure 13:
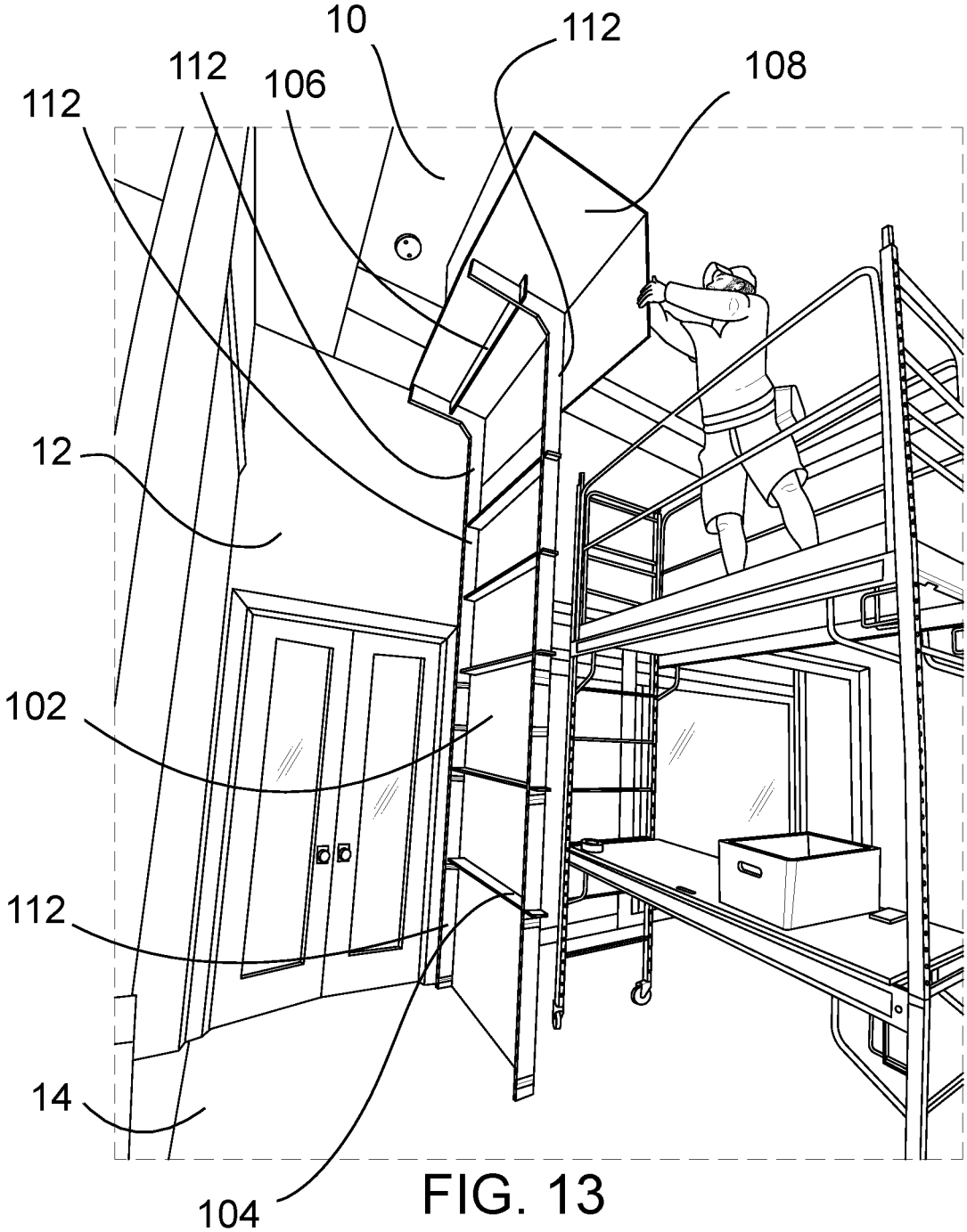
FIG. 13 illustrates a conceptual view of the installation and assembly of an embodiment of the system.
Figures 14, 15:
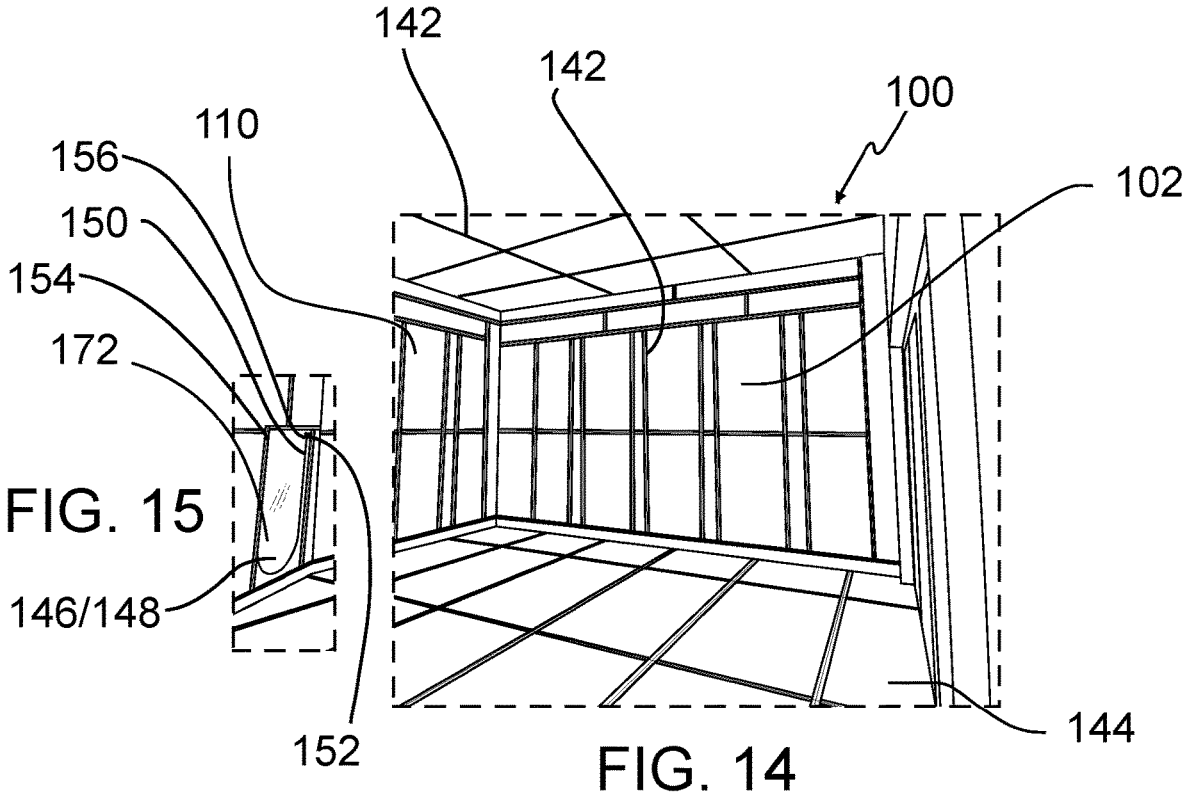
FIG. 14 illustrates a perspective view of the system partially installed in a large room.
FIG. 15 illustrates the zipper door system on an installation in a large room.
Figure 16:
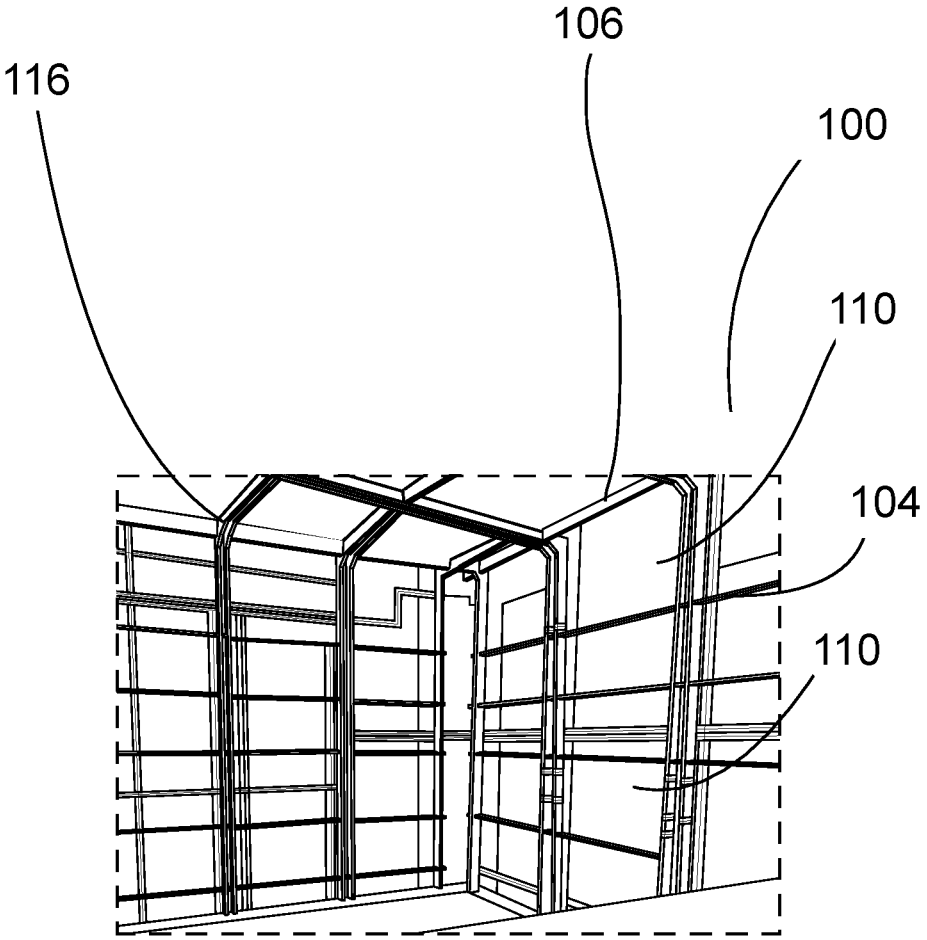
FIG. 16 illustrates a perspective view of the system partially installed in a large room.
Figure 17:
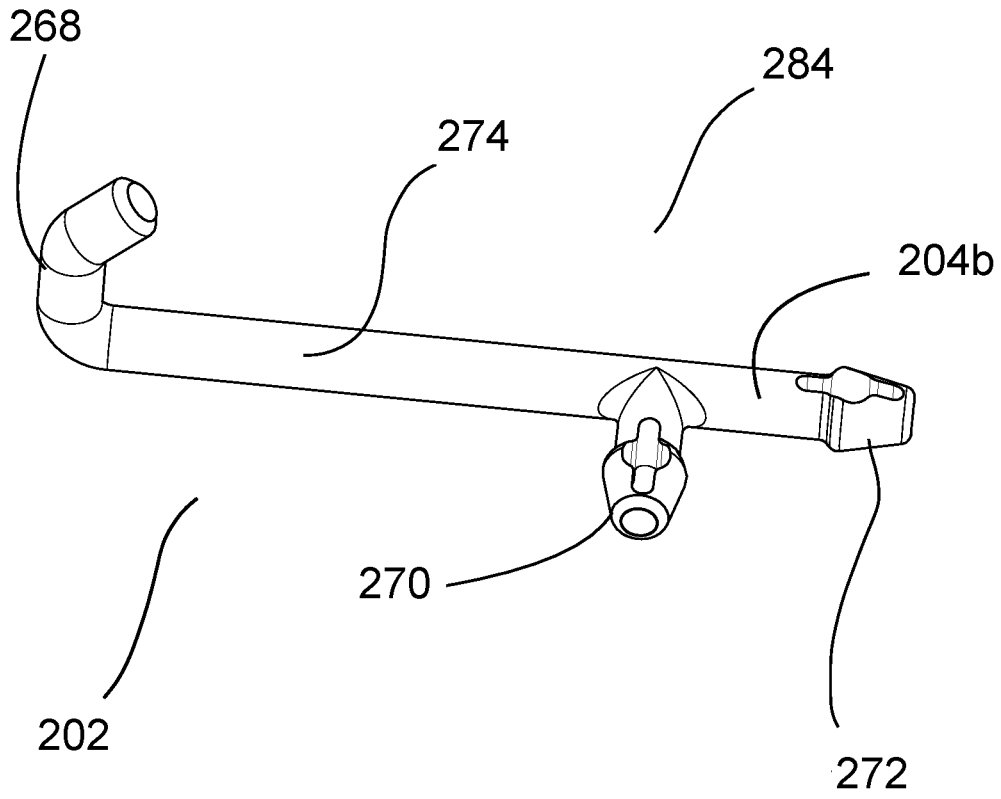
FIG. 17 illustrates an isometric view of the securement anchor.
Figure 18:
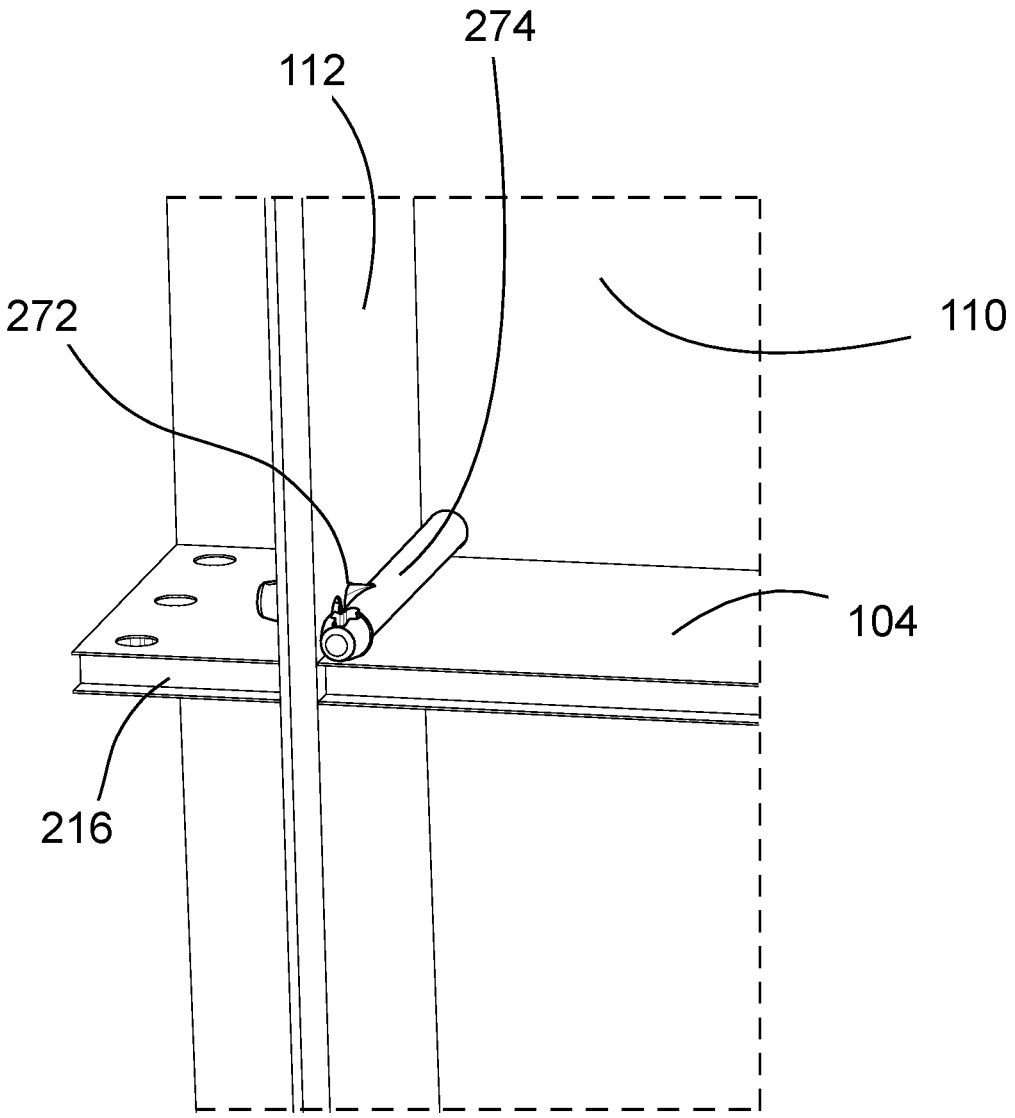
FIGS. 18-21 illustrates various isometric views of the engagement of the securement anchor.
Figure 19:
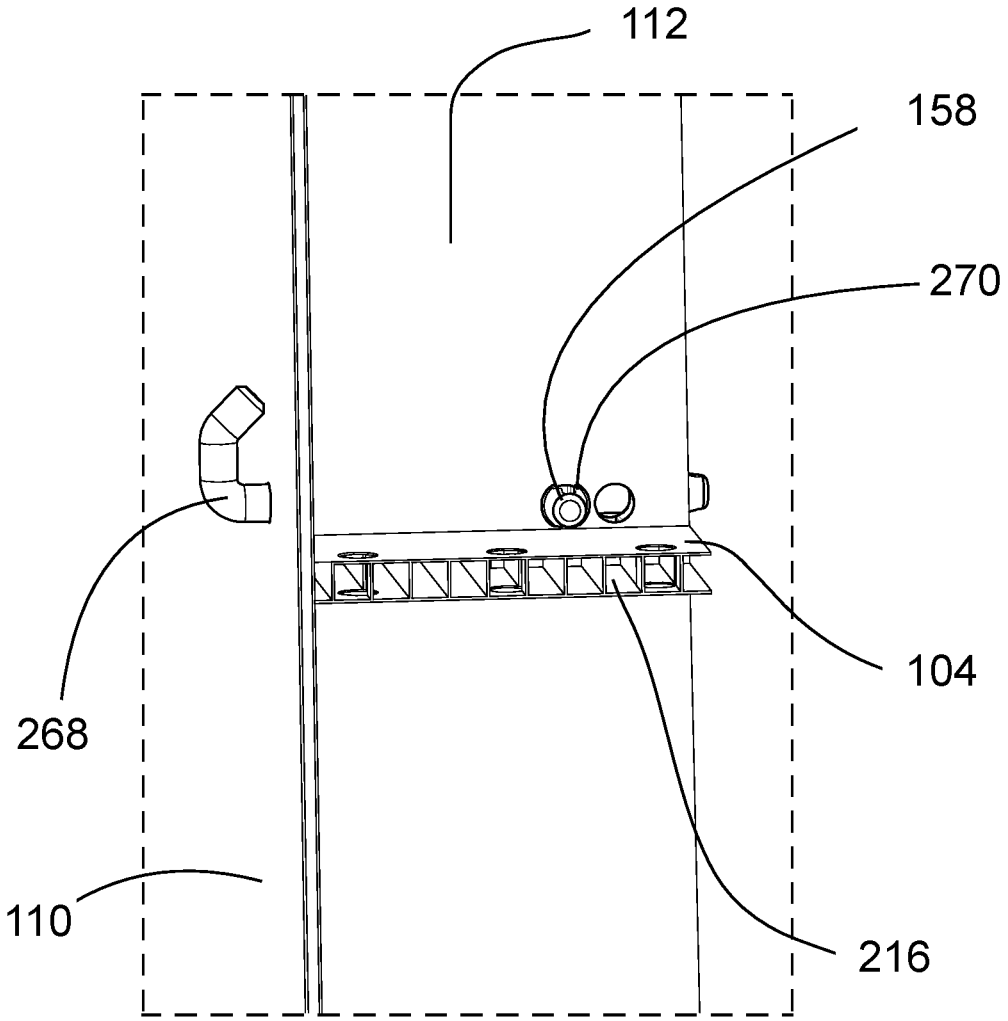
Figure 20:
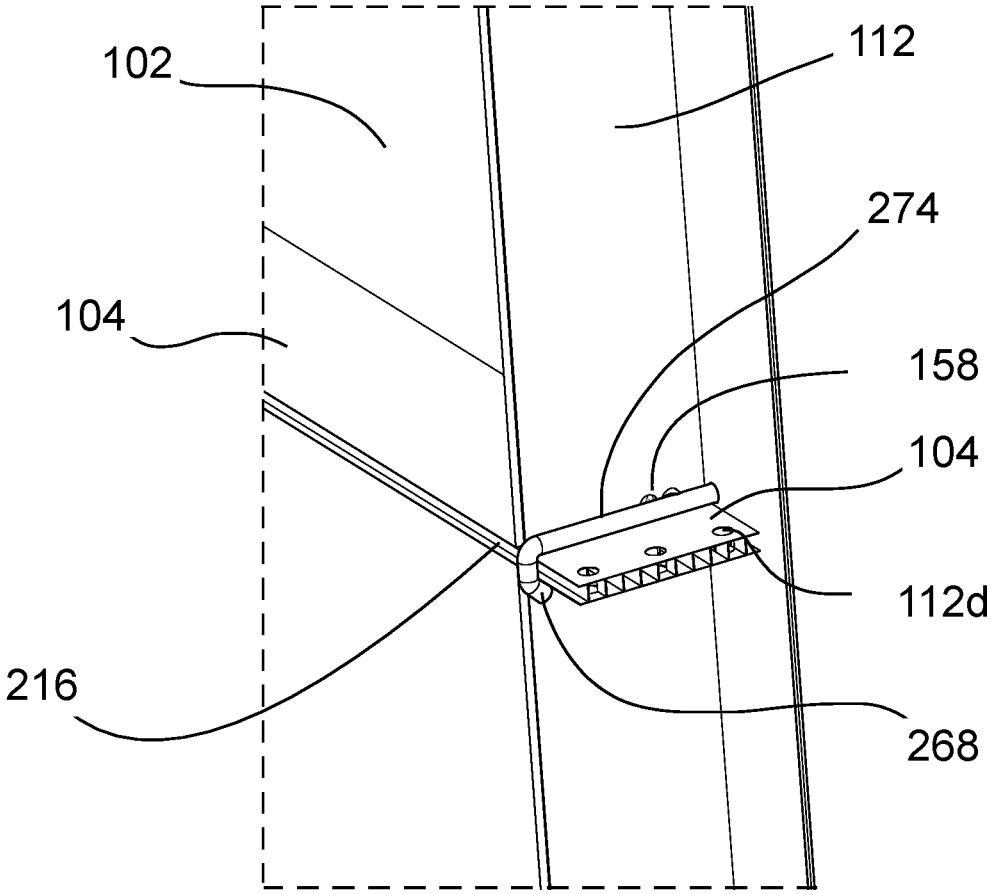
Figure 21:
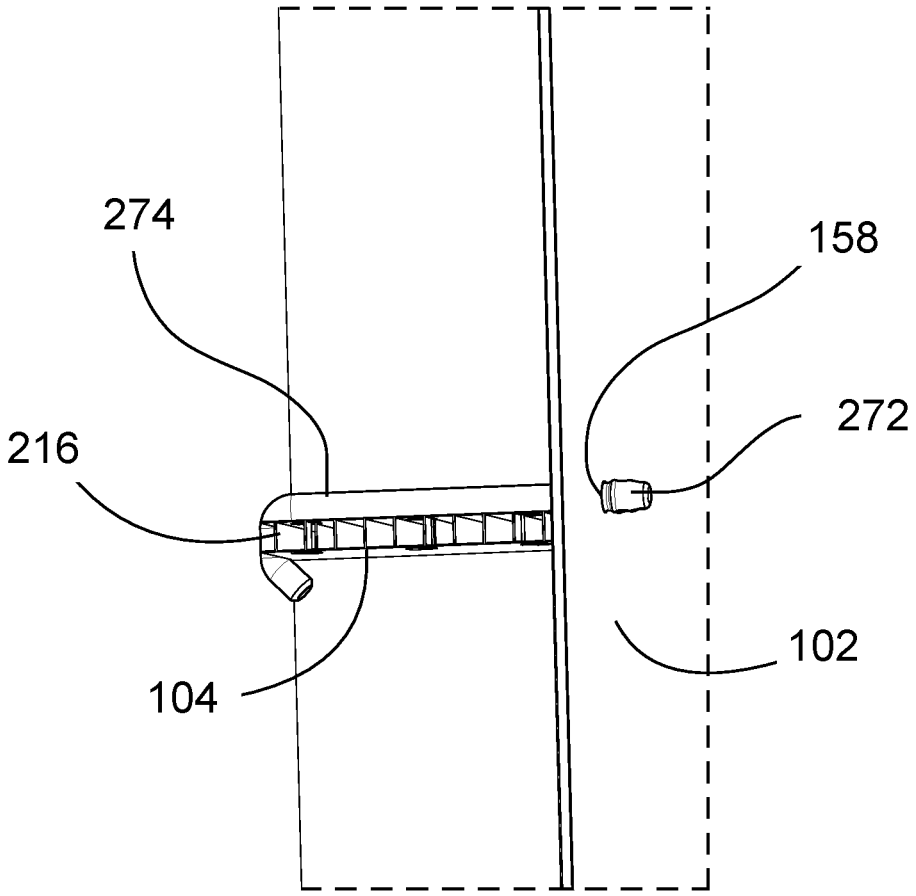
Figure 22:
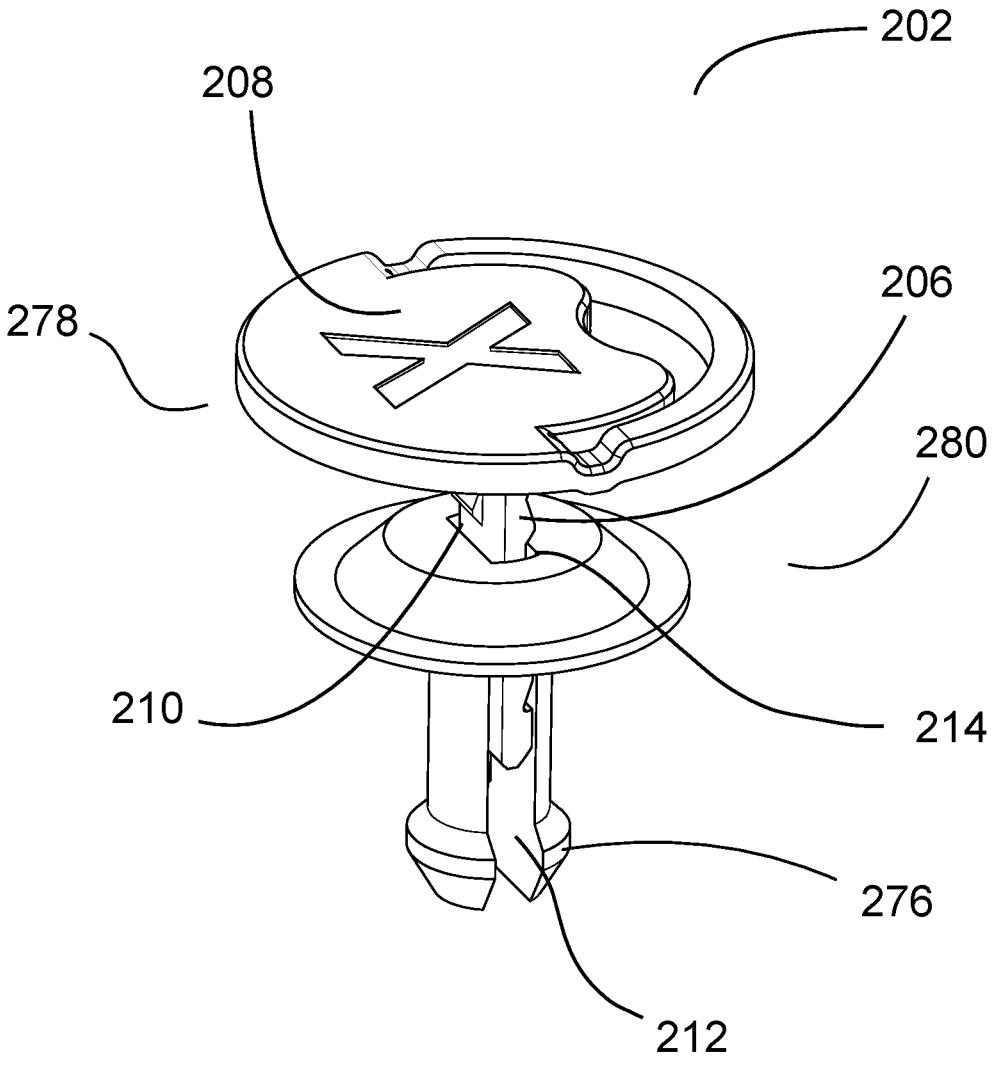
FIG. 22 illustrates an isometric view of the securement peg.
Figure 23:
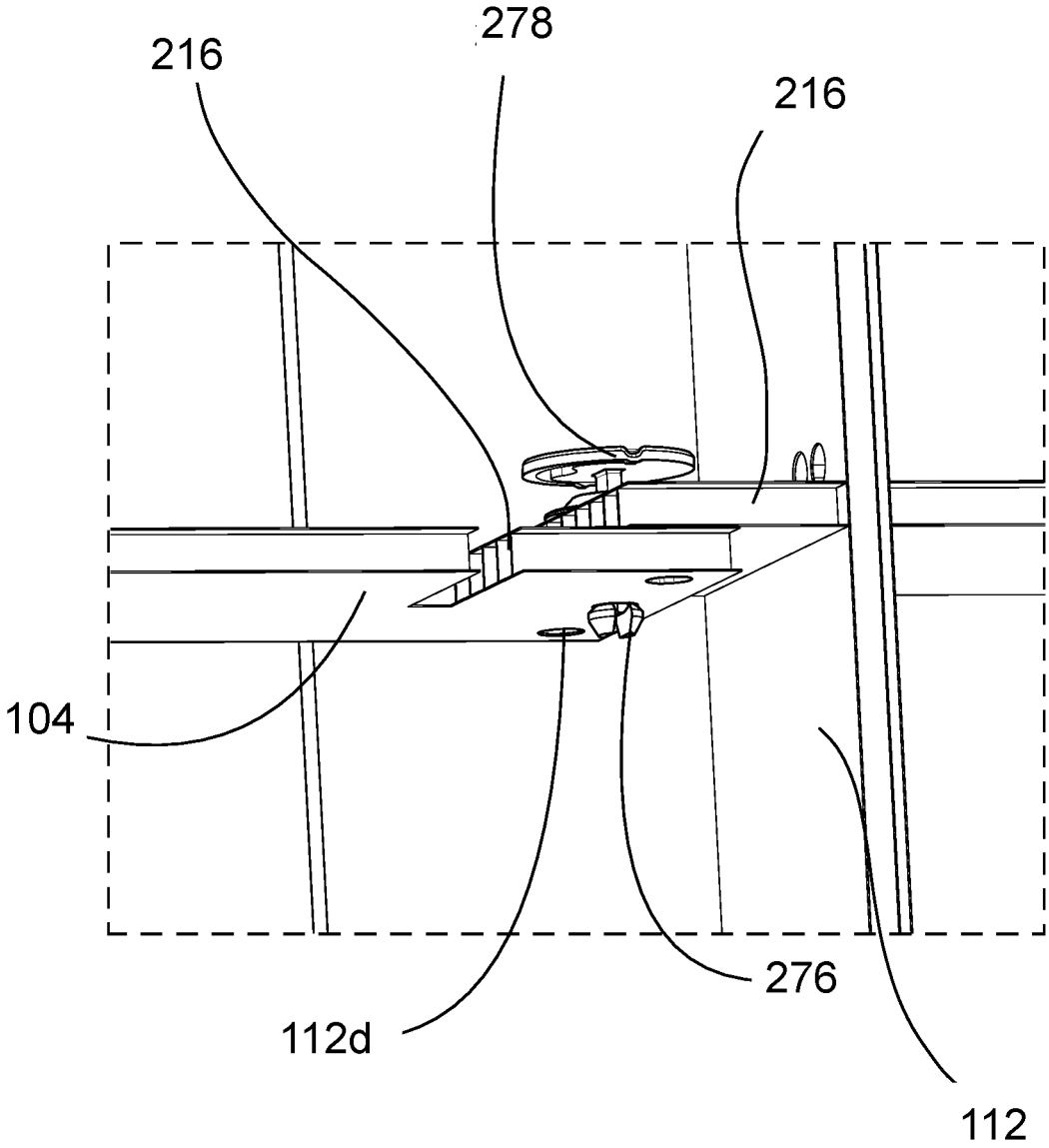
FIGS. 23 and 24 illustrate various isometric views of the engagement of the securement peg.
Figure 24:
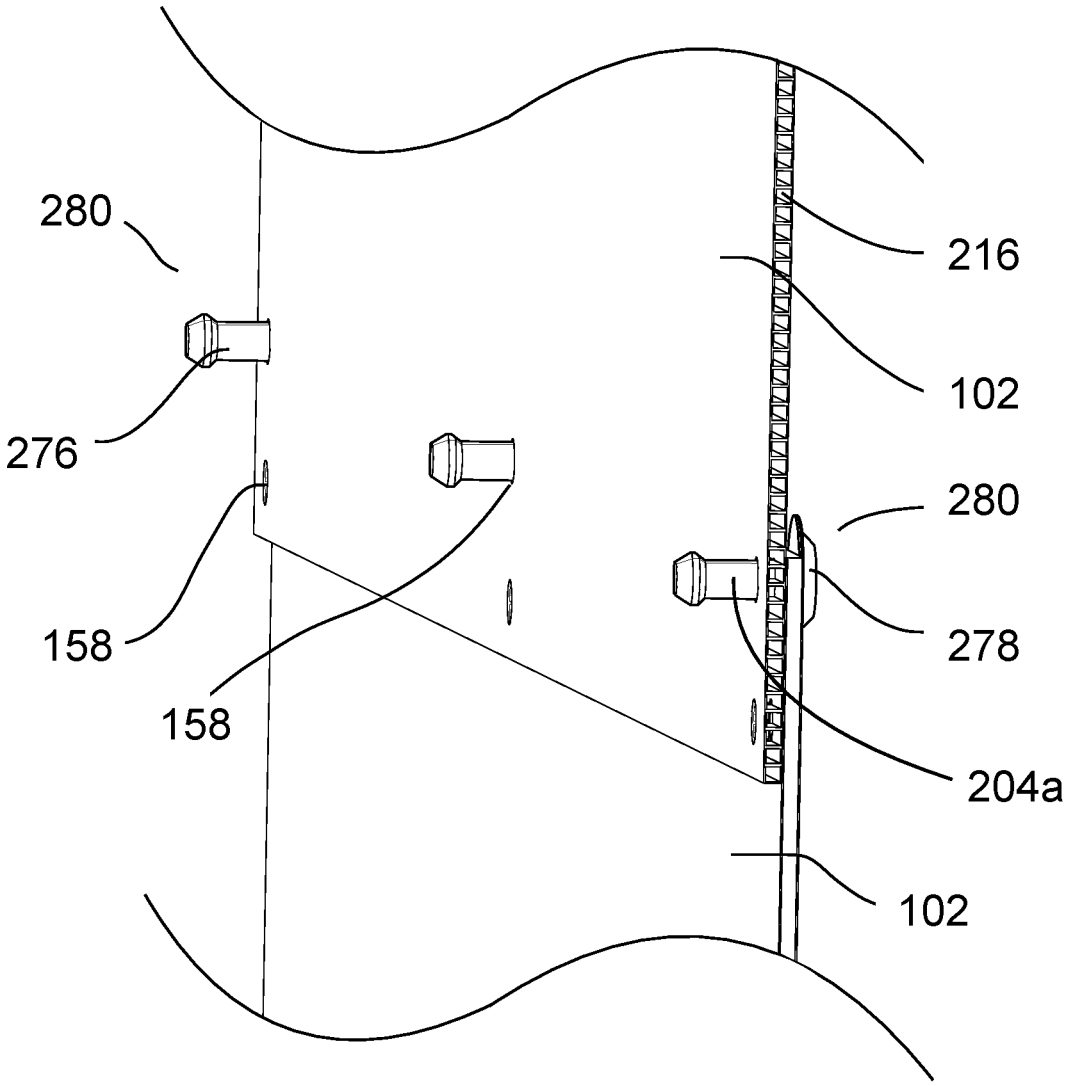
Figure 25:
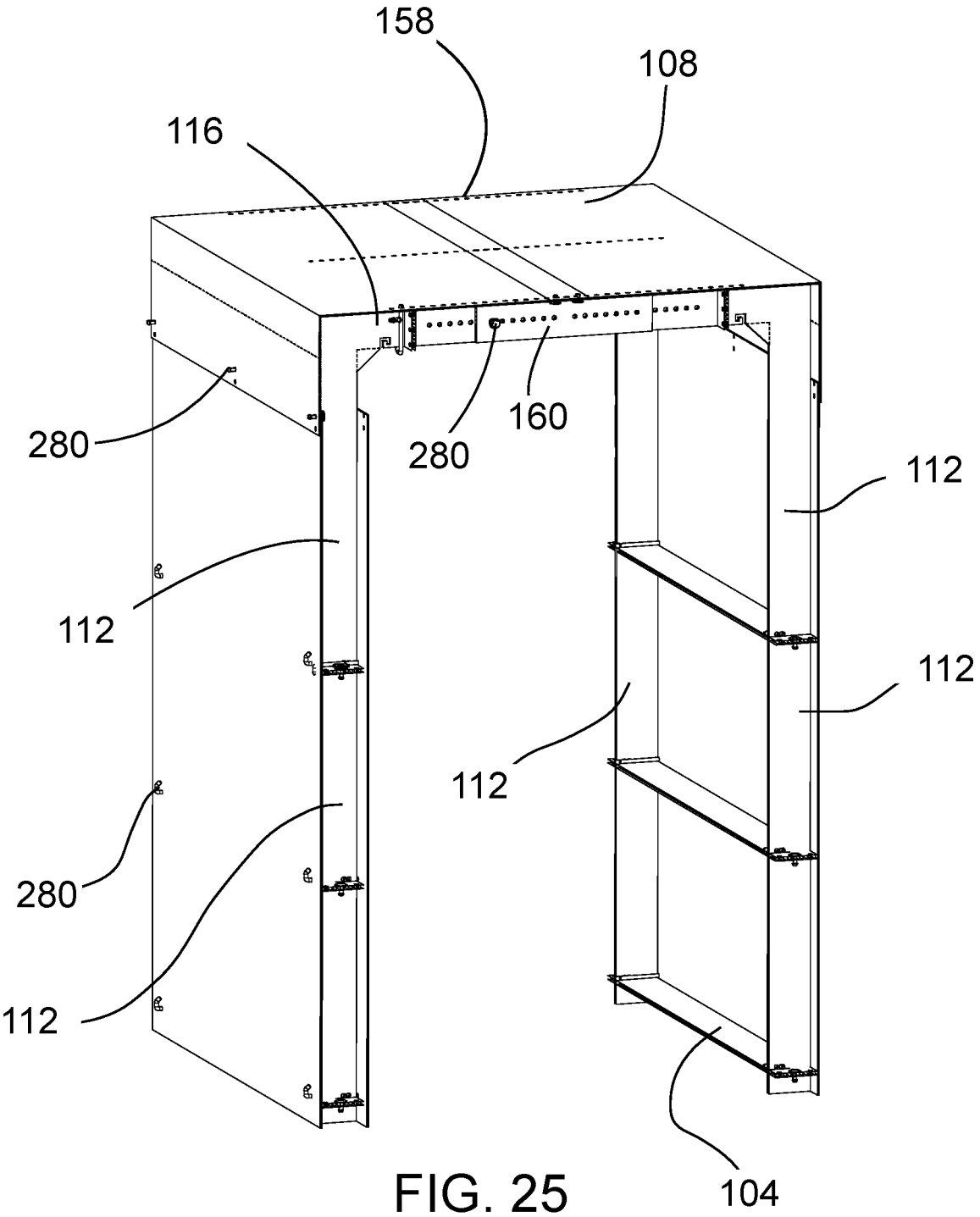
FIG. 25 illustrates an isometric view of an embodiment of the system.
Figure 26:
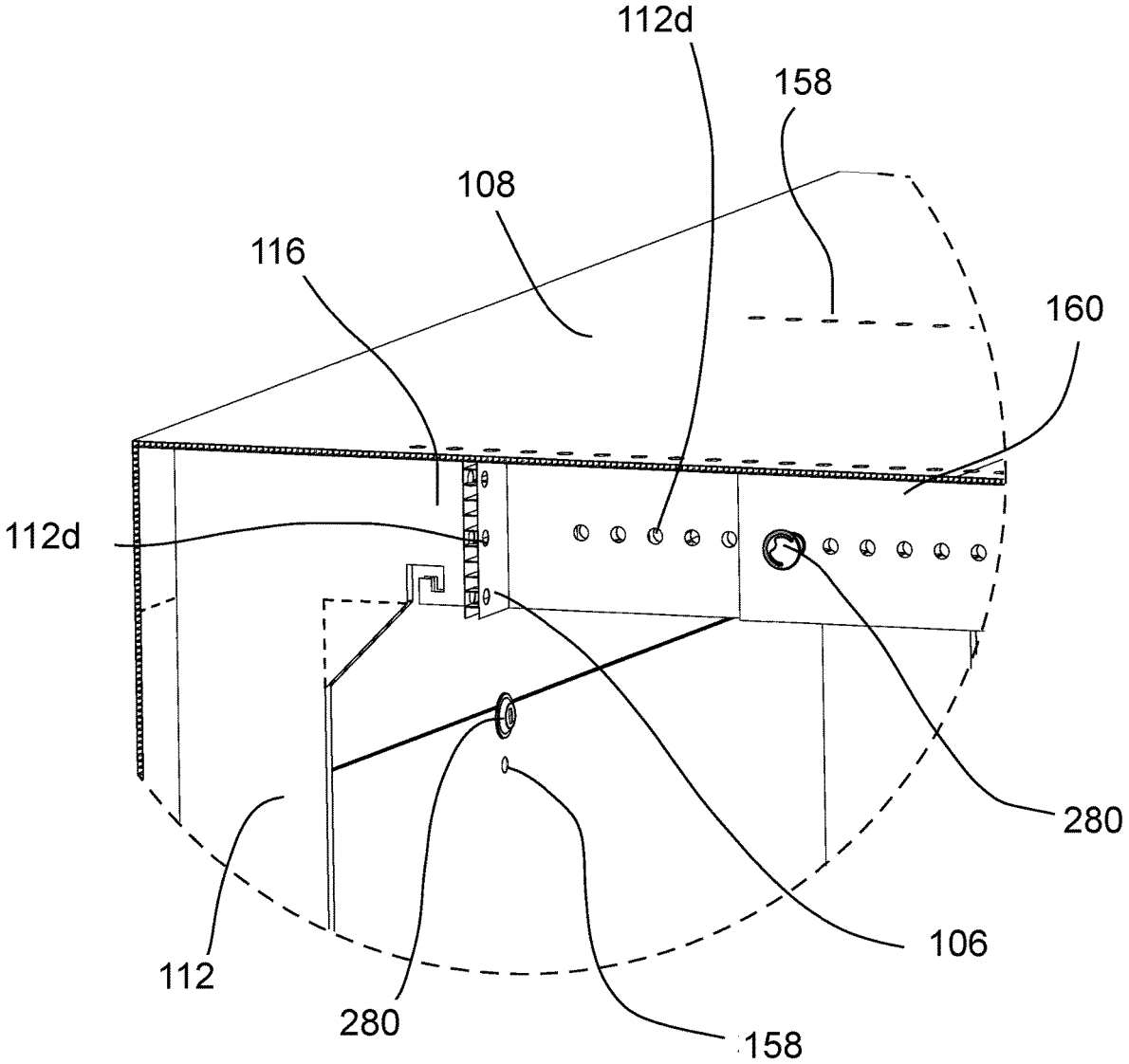
FIG. 26 illustrates an enlarged isometric view of the fastening and mechanics of an embodiment of the tunnel module.

FIG. 1 illustrates a front view of various independent components of the system 100. FIGS. 2-7 illustrate an isometric views of an embodiment of the expandable partition system 100 with an adjustable ceiling. FIG. 8 illustrates an exploded isometric view of an embodiment of the expandable partition system 100 with adjustable ceiling. FIG. 9 illustrates an exploded front elevation view of an embodiment of the expandable partition system 100 with adjustable ceiling. FIG. 10 illustrates a front elevation view of an embodiment of the expandable partition system 100 with adjustable ceiling. FIGS. 11-13 illustrate conceptual views of the installation and assembly of an embodiments of the system 100. FIG. 14 illustrates a perspective view of the system 100 partially installed in a large room. FIG. 15 illustrates the zipper door assembly 172 on an installation in a large room. FIG. 16 illustrates a perspective view of the system 100 partially installed in a large room. FIG. 17 illustrates an isometric view of the securement anchor 284. FIGS. 18-21 illustrates various isometric views of the engagement of the securement anchor 100. FIG. 22 illustrates an isometric view of the securement peg 280. FIGS. 23 and 24 illustrate various isometric views of the engagement of the securement peg 280. FIG. 25 illustrates an isometric view of an embodiment of the system 100. FIG. 26 illustrates an enlarged isometric view of the fastening and mechanics of an embodiment of the system 100.

In an exemplary embodiment, a temporary protective containment barrier system 100 for use during construction and demolition is disclosed. The temporary protective containment barrier system comprises a plurality of wall members 102, a plurality of noggins 104, at least one ceiling joist 106, and at least one ceiling panel 108. Each wall member 102 includes at least one vertical wall panel 110 secured to a vertically adjustable stud member 112, thereby creating a vertical partition 114. The plurality of wall members 102 is comprised of a plurality of the vertically adjustable stud members 112, each with a cantilever 116 positioned at an upper boundary 118. Each vertically adjustable stud member 112 is connectable to a neighboring stud member 112 by the plurality of noggins 104. Each cantilever 116 is connectable to a neighboring cantilever 116 by at least one ceiling joist 106. The temporary protective containment barrier system 100 also includes a plurality of structural fasteners 202 configured to secure said noggins 104 or said ceiling joists 106 to additional noggins 104 or ceiling joists 106 in a plurality of noggins 104 or ceiling joists 106.

The vertical adjustability derives its operation from the use of a plurality of stud members 112. As shown in FIG. 1, the primary stud members 112*a* have a cantilever at the top, and are thus the top stud. Extension studs 112*b*, shown in FIG. 1 and primary stud 112*a* are coupled toward a bottom 112*c* of the primary stud 112*a*, enlarging its vertical height. When positioned at the bottom of the primary stud 112*a*/top of the extension stud 112*b*, the securement and anchoring means, known as the structural fasteners 202 are (as may be appreciated in FIGS. 2-10 and 17-26) fitted through apertures 112*d* so that the connection points are secured. FIGS. 2-10 show various expansions in dimensions, and shows the expansion apertures 112*d* near each connection point. As may be seen, these apertures 112*d* exist in a plurality, where the user can adjust the height incrementally between two studs 112*a*/112*b* for minor height modifications, and may add in a new stud member for significant height increases.

In some embodiments of the temporary protective containment barrier system 100 for use during construction and demolition, each cantilever 116 includes at least one vertical notch 120 with an upper opening 122. Each ceiling joist 106 includes a vertical notch 124 at each distal end 126, wherein each vertical notch 124 has a lower opening 128. The at least one vertical notch 120 of each of the cantilevers 116 is configured for complemental engagement with the vertical notch 124 in the ceiling joist 106, whereby each vertically adjustable stud member 112 is connectable to the neighboring stud member 112 when each of the lower openings 128 of the vertical notches 124 of the ceiling joist 106 are slid down complemental notches 120 with upper openings 122 of said outward cantilever 116.

In some embodiments of the temporary protective containment barrier system 100 for use during construction and demolition, each vertically adjustable stud member 112 includes at least one horizontal notch 130 with an outer opening 132. Each nogging 104 includes a horizontal notch 134 at each distal end 136, wherein each notch 134 has an inner opening 138. The at least one horizontal notch 130 of each of the vertically adjustable stud members 112 is configured for complemental engagement with the horizontal notch 134 in the nogging 104, whereby each vertically adjustable stud member 112 is connectable to the neighboring stud member 112 when each of said inner openings 138 of said horizontal notches 134 of the noggings 104 are slid into complemental horizontal notches 130 with outer openings 132 of the vertically adjustable stud members 112.

In some embodiments of the temporary protective containment barrier system 100 for use during construction and demolition, the temporary protective containment barrier system 100 for use during construction and demolition further includes an adhesive seal element 140 applied between seams 142 of individual components of the temporary protective containment barrier system 100 for use during construction and demolition, wherein the individual components include at least two components in the group comprising: at least one vertical wall panel 110, at least one ceiling panel 108, at least one horizontal floor panel 144, a pre-existing ceiling 10, a pre-existing wall 12, and a pre-existing floor 14. The adhesive seal 140 element may be an adhesive tape 140*a*.

In some embodiments of the temporary protective containment barrier system 100 for use during construction and demolition, a geometry of each nogging 104 is identical to a geometry of each ceiling joists 106 to provide for simplicity and interchangeability, as may be appreciated by viewing FIGS. 1-13.

In some embodiments of the temporary protective containment barrier system 100 for use during construction and demolition, the ceiling panels 108, the wall panels 110, and floor panels 144 are constructed of a corrugated or fluted material 216 thereby configuring said ceiling panels 108, the wall panels 110, and the floor panels 144 for cushion against impacting objects. In some embodiments of the temporary protective containment barrier system 100 for use during construction and demolition, the corrugated or fluted material is a fluted plastic sheet, as may be appreciated in the enlarged views of FIGS. 18-21, 23, 24, and 26.

In some embodiments of the temporary protective containment barrier system 100 for use during construction and demolition, the ceiling joists 106, the noggings 104, and the vertically adjustable stud members 112 are constructed of a corrugated or fluted material thereby configuring the ceiling joists 106, the noggings 104, and the vertically adjustable stud members 112 for cushion against impacting objects, structural strength, thermal buffering, and sound dampening. In some embodiments the corrugated or fluted material is a fluted plastic sheet, as may also be appreciated in the enlarged views of FIGS. 18-21, 23, 24, and 26.

In some embodiments of the temporary protective containment barrier system 100 for use during construction and demolition, each of said vertically adjustable stud members 112 includes a vertical lower stud 112*b*, and an independent and adjustably-coupled vertical upper stud 112*a* with said outward cantilever 116.

In some embodiments of the temporary protective containment barrier system 100 for use during construction and demolition, the system further comprises a door 172 assembly including a panel comprised of a flexible plastic shroud 146 forming a door body 148, a zipper opening 150 integrated within the flexible plastic shroud 146, and a zipper mechanism 152 operatively associated with the zipper opening 150 of the door body 148. The zipper mechanism 152 is adapted to move along a defined path between a first edge 154 and a second edge 156. The zipper mechanism 152 provides selective access through the door assembly 172.

In some embodiments of the temporary protective containment barrier system 100 for use during construction and demolition, the at least one horizontal floor panel 144 is positioned perpendicularly at a lower boundary of the at least one vertical wall panel 110.

In some embodiments of the temporary protective containment barrier system 100 for use during construction and demolition, a plurality of apertures 112*d*/158 are disposed in each of the vertically adjustable stud members 112, cantilevers 116, noggins 104, ceiling joists 106, vertical wall panels 110, and ceiling panels 108, and are configured for receiving a through-hole member of each structural fastener 202.

In some embodiments of the temporary protective containment barrier system 100 for use during construction and demolition, a plurality of horizontal extension beams 160 connecting at distal ends 160*a* to said cantilever 116 of each vertically adjustable stud member 112 are provided. In some embodiments a plurality of apertures 158 disposed in each of the horizontal extension beams 160.

In some embodiments of the temporary protective containment barrier system 100 for use during construction and demolition, the system further includes a plurality of apertures 112*d*/158 disposed in each of the vertically adjustable stud members 112, cantilevers 116, noggins 104, ceiling joists 106, vertical wall panels 110, ceiling panels 108, and are configured for receiving a through-hole member 204*a*/204*b* of each structural fastener 202 in the plurality of structural fasteners 202.

In some embodiments of the temporary protective containment barrier system 100 for use during construction and demolition, the plurality of structural fasteners 202 are configured to secure the noggins 104 and/or the ceiling joists 106 to the studs 112, and includes an elongate anchor body 274 having an engagement cap 272 at a proximal end and an engagement hook 268 at a distal end, and an engagement stem 270 protruding from the anchor body 274 in a direction perpendicular to an axis on which the engagement hook 268 and the engagement cap 272. The engagement hook 268 is configured to engage with one of the nogging 104, ceiling joist 106, wall panel 110, and/or ceiling panel 108, whereby the engagement hook 268 extends through an aperture 158 or around a side of the ceiling joist 106 and/or the nogging 104, thereby bracing the anchor body 274 against the noggins 104 or ceiling joists 106 and the studs 112. The engagement cap 272 is configured to engage with the wall panel 110 and/or the ceiling panel 108, whereby the engagement cap 272 is extendable through an aperture 158 in the wall panel 110 and/or the ceiling panel 108. The engagement stem 270 is configured to engage with the studs 112, whereby the engagement stem 270 extends through an aperture 112*d* in the stud.

In some embodiments, the engagement stem 270 and the engagement cap 272 terminate in a frustoconical nub, whereby the frustoconical shape allows a distal end, with a circumference smaller than that of the aperture (see FIGS. 19 and 21), to slide into the aperture 112*d*/158 and a proximal end, with a circumference larger than that of the aperture 112*d*/158, to poke through and anchor the structural fastener 202.

In some embodiments of the temporary protective containment barrier system 100 for use during construction and demolition, the plurality of structural fasteners 202 configured to secure the noggins 104 or said ceiling joists 106 to additional noggins 104 or ceiling joists 106 comprises a two-part peg 280. A first part 276 of the two-part peg defines an extension shaft 212 configured to recede through an aperture 112*d*/158 in at least one of the vertically adjustable stud members 112, the cantilevers 116, the noggins 104, the ceiling joists 106, the vertical wall panels 110, the ceiling panels 108, and/or the horizontally expandable beam 160. A second part 278 of the two-part system defines a shaft 206 with push surface 208, wherein the shaft 206 engages with a hole 210 in a center of the extension shaft 212 of the first part 276, whereby once pressed into the hole 210 of the first part 276, the shaft 206 of the second part 278 presses against the sidewalls 214 of the hole 210 of the first part 276 thereby expanding the shaft 212 of the first part 276 creating a snug fit within an aperture 112*d*/158 in at least one of the vertically adjustable stud members 112, the cantilevers 116, the noggins 104, the ceiling joists 106, the vertical wall panels 110, the ceiling panels 108, and/or the horizontally expandable beam 160.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A temporary protective containment barrier system for use during construction and demolition, comprising:

a plurality of wall members;

each wall member in said plurality of wall members includes at least one vertical wall panel secured to a vertically adjustable stud member, thereby defining a vertical partition;

said plurality of wall members is comprised of a plurality of said vertically adjustable stud members, each vertically adjustable stud member includes at least one horizontal notch defining an outer opening therein, each vertically adjustable stud member having a cantilever positioned at an upper boundary, each said cantilever includes at least one vertical notch defining an upper opening therein;

a plurality of noggings, each nogging includes a horizontal notch at distal ends thereof defining an inner opening therein;

each vertically adjustable stud member in said plurality of vertically adjustable stud members is configured to connect to a neighboring said stud member by said plurality of noggings;

at least one ceiling joist, each said ceiling joist includes a vertical notch at distal ends thereof defining a lower opening therein;

at least one ceiling panel;

each cantilever in said plurality of vertically adjustable stud members is configured to connect to a neighboring said cantilever by said at least one ceiling joist; and a plurality of structural fasteners configured to secure said noggings or said ceiling joists to adjacent noggings or ceiling joists in a plurality of adjacent noggings or ceiling joists, wherein said at least one vertical notch of each said cantilever is configured for complemental engagement with each said vertical notch in each said ceiling joist, each vertically adjustable stud member is configured to connect to said neighboring stud member such that said lower opening of said vertical notch of each said ceiling joist slides down into said upper opening of said at least one vertical notch of each said cantilever, and wherein said at least one horizontal notch of each said vertically adjustable stud member is configured for complemental engagement with each said horizontal notch in each said nogging, each vertically adjustable stud member is configured to connect to said neighboring stud member such that said inner opening of said horizontal notch of each said nogging slides into said outer opening of said horizontal notch of each said vertically adjustable stud member.

2. The temporary protective containment barrier system for use during construction and demolition, as recited in claim 1, further comprising:

an adhesive seal element applied between seams of individual components of the temporary protective containment barrier system for use during construction and demolition, wherein said individual components include at least two components in the group comprising:

said at least one vertical wall panel;

at least one ceiling panel;

at least one horizontal floor panel;

a pre-existing ceiling;

a pre-existing wall;

a pre-existing floor; and wherein said adhesive seal element is an adhesive tape.

3. The temporary protective containment barrier system for use during construction and demolition, as recited in claim 1, wherein a geometry of each nogging is identical to a geometry of each ceiling joists to provide for simplicity and interchangeability.

4. The temporary protective containment barrier system for use during construction and demolition, as recited in claim 1, wherein each of said vertically adjustable stud members includes:

a vertical lower stud; and an independent and adjustably-coupled vertical upper stud with said cantilever.

5. The temporary protective containment barrier system for use during construction and demolition, as recited in claim 1, further comprising:

a door assembly including a panel comprised of a flexible plastic shroud forming a door body;

a zipper opening integrated within said flexible plastic shroud; and a zipper mechanism operatively associated with the zipper opening of the door body, wherein the zipper mechanism is adapted to move along a defined path between a first edge and a second edge, and wherein said zipper mechanism provides selective access through the door assembly.

6. The temporary protective containment barrier system for use during construction and demolition, as recited in claim 1, wherein ceiling panels, said wall panels, and floor panels are constructed of a corrugated or fluted material thereby configuring said ceiling panels, said wall panels, and said floor panels for cushion against impacting objects.

7. The temporary protective containment barrier system for use during construction and demolition, as recited in claim 6, wherein the corrugated or fluted material is a fluted plastic sheet.

8. The temporary protective containment barrier system for use during construction and demolition, as recited in claim 1, wherein said ceiling joists, said noggings, and said vertically adjustable stud members are constructed of a corrugated or fluted material thereby configuring said ceiling joists, said noggings, and said vertically adjustable stud members for cushion against impacting objects, structural strength, thermal buffering, and sound dampening.

9. The temporary protective containment barrier system for use during construction and demolition, as recited in claim 8, wherein the corrugated or fluted material is a fluted plastic sheet.

10. The temporary protective containment barrier system for use during construction and demolition, as recited in claim 1, further comprising:

at least one horizontal floor panel positioned perpendicularly at a lower boundary of said at least one vertical wall panel.

11. The temporary protective containment barrier system for use during construction and demolition, as recited in claim 10, further comprising:

a plurality of apertures disposed in each of said vertically adjustable stud members, cantilevers, noggins, ceiling joists, vertical wall panels, and ceiling panels, configured for receiving a through-hole member of each structural fastener in said plurality of structural fasteners.

12. The temporary protective containment barrier system for use during construction and demolition, as recited in claim 10, wherein the plurality of structural fasteners configured to secure said noggins or said ceiling joists to additional noggins or ceiling joists in a plurality of noggins or ceiling joists comprise:

a two-part peg, wherein a first part of said two-part peg defines an extension shaft configured to recede through an aperture in at least one of said vertically adjustable stud members, said cantilevers, said noggins, said ceiling joists, said vertical wall panels, said ceiling panels, and said horizontally expandable beam; and a second part of said two-part system defines a shaft with push surface, wherein said shaft engages with a hole in a center of said extension shaft of said first part, whereby once pressed into said hole of said first part, said shaft of said second part presses against the sidewalls of the hole of the first part thereby expanding the shaft of the first part creating a snug fit within an aperture in at least one of said vertically adjustable stud members, said cantilevers, said noggins, said ceiling joists, said vertical wall panels, said ceiling panels, and said horizontally expandable beam.

13. The temporary protective containment barrier system for use during construction and demolition, as recited in claim 10, wherein said plurality of structural fasteners configured to secure said noggins or said ceiling joists to said studs comprise:

an elongate anchor body having an engagement cap at a proximal end and an engagement hook at a distal end, and an engagement stem protruding from said anchor body in a direction perpendicular to an axis on which said engagement hook and said engagement cap;

wherein said engagement hook is configured to engage with one of said nogging, said ceiling joist, said wall panel, and said ceiling panel, whereby said engagement hook extends through an aperture or around a side of said ceiling joist or said nogging, thereby bracing said anchor body against said noggins or ceiling joists and said studs;

wherein said engagement cap is configured to engage with said wall panel or said ceiling panel, whereby said engagement cap is extendable through an aperture in said wall panel or said ceiling panel; and wherein said engagement stem is configured to engage with said studs, whereby said engagement step extends through an aperture in said stud.

14. The temporary protective containment barrier system for use during construction and demolition, as recited in claim 13, wherein said engagement stem and said engagement cap terminate in a frustoconical nub, whereby said frustoconical shape allows a distal end, with a circumference smaller than that of said aperture, to slide into said aperture and a proximal end, with a circumference larger than that of said aperture, to poke through and anchor said structural fastener.

15. The temporary protective containment barrier system for use during construction and demolition, as recited in claim 10, further comprising:

a plurality of horizontal extension beams connecting at distal ends to said cantilever of each vertically adjustable stud member.

16. The temporary protective containment barrier system for use during construction and demolition, as recited in claim 15, further comprising:

a plurality of apertures disposed in each of said horizontal extension beams.

17. The temporary protective containment barrier system for use during construction and demolition, as recited in claim 16, further comprising:

a plurality of apertures disposed in each of said vertically adjustable stud members, cantilevers, noggins, ceiling joists, vertical wall panels, ceiling panels, configured for receiving a through-hole member of each structural fastener in said plurality of structural fasteners.

* * * * *